US011112758B2

(12) United States Patent
Tu

(10) Patent No.: US 11,112,758 B2
(45) Date of Patent: Sep. 7, 2021

(54) TIMEPIECE ESCAPEMENT DEVICE AND OPERATING METHOD OF SUCH A DEVICE

(71) Applicant: DETRA SA, Préverenges (CH)

(72) Inventor: Xuan Mai Tu, Ecublens (CH)

(73) Assignee: DETRA SA, Préverenges (CH)

( * ) Notice: Subject to any disclaimer, the term of this patent is extended or adjusted under 35 U.S.C. 154(b) by 459 days.

(21) Appl. No.: 16/064,131

(22) PCT Filed: Dec. 21, 2016

(86) PCT No.: PCT/EP2016/082258
§ 371 (c)(1),
(2) Date: Jun. 20, 2018

(87) PCT Pub. No.: WO2017/109004
PCT Pub. Date: Jun. 29, 2017

(65) Prior Publication Data

US 2018/0373201 A1 Dec. 27, 2018

(30) Foreign Application Priority Data

Dec. 21, 2015 (CH) ..... 01887/15

(51) Int. Cl.

| | |
|---|---|
| ***G04B 15/08*** | (2006.01) |
| ***G04B 15/10*** | (2006.01) |
| ***G04B 15/06*** | (2006.01) |
| *G04B 15/14* | (2006.01) |
| *G04B 19/02* | (2006.01) |

(52) U.S. Cl.
CPC ..... *G04B 15/08* (2013.01); *G04B 15/06* (2013.01); *G04B 15/10* (2013.01); *G04B 15/14* (2013.01); *G04B 19/02* (2013.01)

(58) Field of Classification Search
CPC ..... G04B 15/08; G04B 15/10; G04B 15/06; G04B 15/14; G04B 19/02
See application file for complete search history.

(56) References Cited

U.S. PATENT DOCUMENTS 133,434 A * 11/1872 Giroud ..... G04B 15/08 368/133
9,052,694 B2 6/2015 Tu
(Continued)

FOREIGN PATENT DOCUMENTS

| | | |
|---|---|---|
| EP | 1 122 617 A1 | 8/2001 |
| WO | 2011/064682 A1 | 6/2011 |
| WO | 2013/182243 A1 | 12/2013 |

OTHER PUBLICATIONS

International Search Report and Written Opinion dated Apr. 20, 2017 issued in corresponding application No. PCT/EP2016/082258; w/ English partial translation and partial machine translation (24 pages).

*Primary Examiner* — Sean Kayes
(74) *Attorney, Agent, or Firm* — Westerman, Hattori, Daniels & Adrian, LLP

(57) ABSTRACT

The invention relates to an escapement device (400) comprising a first escapement wheel (1), a second escapement wheel (2), and a brake-lever (3), said second escapement wheel being disposed between the first escapement wheel and the brake-lever, in particular the second escapement wheel coming into contact and engaging with both the first escapement wheel and the brake-lever.

26 Claims, 15 Drawing Sheets

(56) References Cited

U.S. PATENT DOCUMENTS

| | | | | |
|---|---|---|---|---|
| 2008/0008051 | A1* | 1/2008 | Marmy | G04B 15/08 368/170 |
| 2008/0259738 | A1* | 10/2008 | Cabezas Jurin | G04B 17/063 368/131 |
| 2008/0279052 | A1* | 11/2008 | Rochat | G04B 15/06 368/131 |
| 2011/0310709 | A1* | 12/2011 | Vaucher | G04B 15/08 368/132 |
| 2013/0176830 | A1 | 7/2013 | Ferrara | |
| 2015/0131414 | A1 | 5/2015 | Tu | |

* cited by examiner

TIMEPIECE ESCAPEMENT DEVICE AND OPERATING METHOD OF SUCH A DEVICE

The invention relates to a method of functioning of a timepiece escapement device. The invention further relates to a timepiece escapement device. The invention further relates to a watch movement comprising such a device. The invention finally relates to a timepiece comprising such a device or such a watch movement. The invention also relates to a transmission device and a timepiece comprising such a transmission device.

The known escapement devices such as the Swiss lever escapement or the escapement of Robin type, described for example in the patent EP1122617B1, typically comprise an escapement wheel, as well as a blocking-lever. The escapement wheel is formed by a first escapement pinion engaging with or taking part in the geartrain of a timepiece movement and an escapement wheel designed to cooperate by contact with the blocking-lever, which is itself designed to cooperate by contact with an oscillator, especially a sprung balance, in particular an impulse-pin of a sprung balance. In the disengagement phase, the impulse-pin directly actuates the blocking-lever, via a fork of the blocking-lever, which itself acts directly against the escapement wheel. Such escapement devices have relatively low efficiencies, on the order of 30% to 40%.

The purpose of the invention is to provide a timepiece escapement device able to remedy the aforementioned drawbacks and to improve the timepiece escapement devices known in the prior art. In particular, the invention proposes an escapement device whose mechanical efficiency is improved.

A method of functioning regarding the invention is defined by point 1 below.

1. A method of functioning of an escapement device situated between a wheel of a geartrain and an oscillator, the escapement device comprising a first escapement wheel pivoted about a first axis, a second escapement wheel pivoted about a second axis, and a blocking-lever, the method involving a disengagement phase, in which there are simultaneously applied to the second escapement wheel:

a first force of the first escapement wheel, and a second force of the blocking-lever, the intensity of the second force being less than the intensity of the first force, in particular, the intensity of the second force being less than 0.5 times, or less than 0.3 times, or less than 0.2 times the intensity of the first force.

Various embodiments of the method of functioning are defined by points 2 to 4 below.

2. The method of functioning as defined in point 1, characterized in that it further involves an impulse phase in which the first escapement wheel applies, directly to the oscillator or directly to the second escapement wheel, a third force directed substantially orthoradially with respect to the axis of the first escapement wheel or to the axis of the second escapement wheel or to the axis of the oscillator.

3. The method of functioning as defined in point 1 or 2, characterized in that it involves an impulse phase in which the second escapement wheel applies, directly to the oscillator or directly to the blocking-lever, a fourth force directed substantially orthoradially with respect to the axis of the second escapement wheel or to the axis of the blocking-lever or to the axis of the oscillator.

4. The method of functioning as defined in one of the preceding points, characterized in that it further involves an impulse phase in which the intensity of the torque transmitted from the first escapement wheel to the second escapement wheel or to an oscillator during the impulse phase is greater than 1.5 times, or greater than 2 times, the intensity of the torque transmitted from the first escapement wheel to the second escapement wheel during a disengagement phase.

An escapement device regarding the invention is defined by point 5 below.

5. An escapement device comprising a first escapement wheel, a second escapement wheel, and a blocking-lever, the second escapement wheel being situated between the first escapement wheel and the blocking-lever, in particular the second escapement wheel cooperating by contact with the first escapement wheel on the one hand and with the blocking-lever on the other hand.

Various embodiments of the escapement device are defined by points 6 to 13 below.

6. The escapement device as defined in the preceding point, characterized in that the first escapement wheel, the second escapement wheel and the blocking-lever are configured and arranged such that in the disengagement phase of the escapement device a force of the blocking-lever controlled by the oscillator is transmitted to the first escapement wheel via the second escapement wheel.

7. The escapement device as defined in one of points 5 and 6, characterized in that the first escapement wheel, the second escapement wheel and the blocking-lever are configured and arranged such that in the disengagement phase of the escapement device a first force of the first escapement wheel is applied to the second escapement wheel and a second force of the blocking-lever is applied to the second escapement wheel, the intensity of the second force being less than the intensity of the first force, in particular, the intensity of the second force being less than 0.5 times, or less than 0.3 times, or less than 0.2 times the intensity of the first force.

8. The escapement device as defined in one of points 5 to 7, characterized in that the first escapement wheel, the second escapement wheel and the blocking-lever are configured and arranged such that in the impulse phase of the escapement device:

a third force of the first escapement wheel applied directly to the second escapement wheel or applied directly to an oscillator is directed substantially orthoradially with respect to the axis of the first escapement wheel or to the axis of the second escapement wheel or to the axis of the oscillator; and/or a fourth force of the second escapement wheel applied directly to the blocking-lever or applied directly to an oscillator is directed substantially orthoradially to the axis of the second escapement wheel or to the axis of the blocking-lever or to the axis of the oscillator.

9. The escapement device as defined in one of points 5 to 8, characterized in that the second escapement wheel is a second pinion or in that the second escapement wheel comprises a second pinion and a second wheel.

10. The escapement device as defined in one of points 5 to 8, characterized in that the second escapement wheel comprises a second pinion, the second pinion being arranged to cooperate with the first escapement wheel, the first escapement wheel, particularly a first wheel of the first escapement wheel, having a diameter greater than, particularly more than 1.5 times greater than, or more than 2 times greater than the diameter of the second pinion of the second escapement wheel.

11. The escapement device as defined in one of points 5 to 10, characterized in that the second escapement wheel comprises impulse surfaces oriented at least substantially radially with respect to the axis of the second escapement wheel and/or resting surfaces oriented to form an angle between 15° and 50°, or between 20° and 45°, between the tangent to the surface and an orthoradial vector with respect to the axis of the second escapement wheel in the area of the resting surface and/or in that the blocking-lever comprises impulse surfaces oriented at least substantially radially with respect to the axis of the blocking-lever and/or resting surfaces oriented at least substantially orthoradially with respect to the axis of the blocking-lever.

12. The escapement device as defined in one of points 9 to 10, characterized in that the second wheel comprises impulse surfaces oriented at least substantially orthoradially with respect to the axis of the second escapement wheel and/or resting surfaces oriented at least substantially radially with respect to the axis of the second escapement wheel and/or in that the second pinion comprises impulse surfaces oriented at least substantially radially with respect to the axis of the second escapement wheel and/or resting surfaces oriented to form an angle between 15° and 50°, or between 20° and 45°, between the tangent to the surface and an orthoradial vector with respect to the axis of the second escapement wheel in the area of the resting surface.

13. The escapement device as defined in one of points 5 to 12, characterized in that the first escapement wheel, the second escapement wheel and the blocking-lever are configured and arranged such that in the disengagement phase of the escapement device a first force of the first escapement wheel on the second escapement wheel at a first point of contact makes an angle less than 50°, or less than 30°, or less than 20° with a radial vector with respect to the axis of the second escapement wheel at the first point of contact and/or in that the first escapement wheel, the second escapement wheel and the blocking-lever are configured and arranged such that in the disengagement phase:

- a ray having as its origin the axis of the second escapement wheel and passing through a first point of contact where a first force of the first escapement wheel is applied to the second escapement wheel; and
- a ray having as its origin the axis of the second escapement wheel and passing through the axis of the second escapement wheel;

make an angle greater than 10°, or greater than 20°, or greater than 30°;

and/or

- a ray having as its origin the axis of the first escapement wheel and passing through the axis of the second escapement wheel; and
- a ray having as its origin the axis of the first escapement wheel and passing through a first point of contact where a first force of the first escapement wheel is applied to the second escapement wheel;

make an angle greater than 5°, or greater than 10°, or greater than 20°.

A watch movement regarding the invention is defined by point 14 below.

14. A watch movement comprising an escapement device as defined in one of points 5 to 13, in particular comprising a geartrain, an oscillator and an escapement device as defined in one of points 5 to 13, the escapement device being situated between the geartrain and the oscillator.

A timepiece regarding the invention is defined by point 15 below.

15. A timepiece comprising an escapement device as defined in one of points 5 to 13 or a watch movement as defined in the preceding point.

A transmission device regarding the invention is defined by point 16 below.

16. A mechanical transmission device for a timepiece designed to transmit a torque, in particular designed to transmit a variable torque and/or a torque transmitted by a barrel, to an escapement wheel, comprising:

- a pinion having resting surfaces and impulse surfaces, mounted on the same axis as the escapement wheel,
- a wheel or first escapement wheel subjected to a torque from the barrel, characterized in that the resting surfaces and the impulse surfaces are arranged such that the torque transmitted by the wheel or first escapement wheel to the pinion in the impulse phase is substantially greater than the torque transmitted by the wheel to the pinion in the disengagement phase.

Various embodiments of the transmission device are defined by points 17 to 20 below.

17. The mechanical transmission device as defined in point 16, characterized in that the angle between the normal to the surface and the straight line is between 0 and 60°.

18. The mechanical transmission device defined in point 16 or 17, characterized in that the number of teeth of the pinion is equal to the number of teeth of the escapement wheel.

19. The mechanical transmission device as defined in point 16 or 17, characterized in that the number of teeth of the pinion is equal to twice the number of teeth of the escapement wheel.

20. The mechanical transmission device as defined in one of points 16 to 19, characterized in that the number of teeth of the escapement wheel is less than or equal to ten.

A timepiece regarding the invention is defined by point 21 below.

21. A timepiece provided with a mechanical transmission device as defined in one of points 16 to 20.

The appended figures represent, as examples, two embodiments of a timepiece according to the invention.

Figure 1:
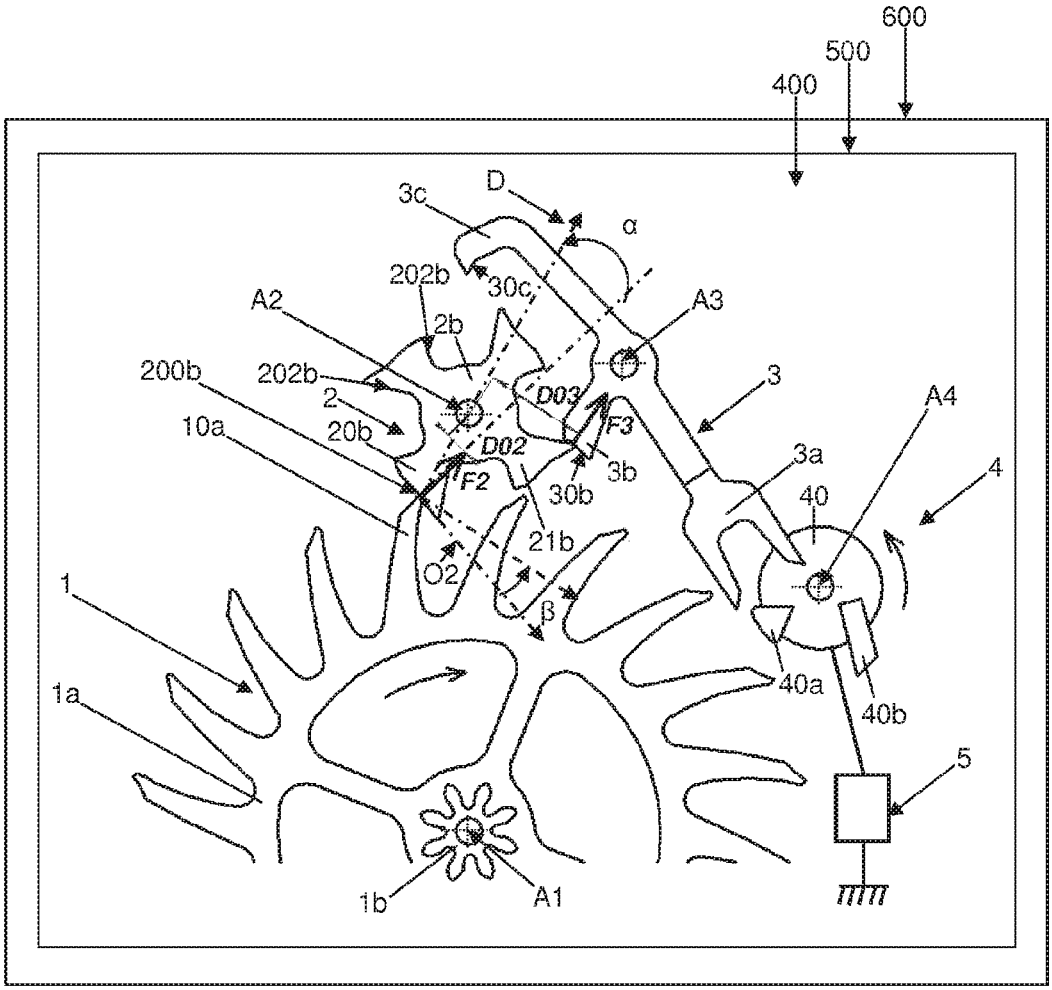
FIG. 1 is a schematic view of a first embodiment of a timepiece according to the invention comprising a first variant of a first embodiment of an escapement in a first resting position.

A first embodiment of a timepiece 600 is described below in reference to FIGS. 1 to 8. The timepiece is for example a watch, in particular a wristwatch. The timepiece comprises a first embodiment of a watch movement 500, in particular a mechanical movement. The movement comprises a first variant of a first embodiment of an escapement device 400 situated between a wheelwork and an oscillator 4, 5.

The wheelwork is designed to connect a motor means, such as a barrel, to the escapement. The wheelwork thus enables a transmission of energy from the motor means to the escapement. As for the escapement, this makes it possible to furnish energy to the oscillator in order to maintain its oscillations.

The oscillator is for example an oscillator of the balance 4 and spring 5 type. The balance is pivoted about an axis A4.

The escapement device 400 comprises primarily a first escapement wheel 1 pivoted about an axis A1, a second escapement wheel 2 pivoted about an axis A2, and a blocking-lever 3 pivoted about an axis A3. The first escapement wheel, the second escapement wheel and the blocking-lever are configured and arranged so that, in a disengagement phase of the escapement device, a force of the blocking-lever controlled by the oscillator 4, 5 is transmitted to the first escapement wheel by way of the second escapement wheel. A disengagement phase involves in particular a disengagement phase of the blocking means of the blocking-lever from the toothing of the second escapement wheel 2 driven by the oscillator 4, 5, that is, the positions of the blocking-lever are determined by the positions of the oscillator.

The first escapement wheel 1 comprises a first escapement wheel 1*a* able to act, directly or not, on the timepiece oscillator. A first pinion 1*b* of the geartrain is joined firmly in rotation with the first escapement wheel 1*a*, in particular, it is secured to the first escapement wheel 1*a*, in particular, it is secured coaxially to the first escapement wheel 1*a*.

In the first embodiment of the escapement device, the second escapement wheel comprises a single second escapement pinion 2*b*.

In a preferred variant of the first embodiment, the escapement device is a direct-impulse escapement device, whose principle of operation is similar to that of a Robin type escapement device. This may be designed, for example, to cooperate with an oscillator of the balance 4 and spring 5 type.

The first escapement wheel 1*a* is designed to actuate directly the balance 4 and spring 5 by way of one of its teeth, which acts during each impulse phase of the escapement device against an impulse pallet-stone 40*b* of a plate 40 of the balance 4. Thus, the balance in the impulse phase receives energy directly from the first escapement wheel 1*a*. One thus avoids friction losses caused by the blocking-levers of the indirect-impulse escapement devices. To accomplish this, the first escapement wheel 1*a* is linked kinematically to the motor means of the timepiece movement via the first pinion 1*b*.

To minimize as much as possible the energy of disengagement to be furnished by the balance, the first escapement wheel 1*a* is able to be blocked by the blocking-lever 3 thanks to the second escapement wheel 2*b* which is situated between the first escapement wheel 1 and the blocking-lever 3. To accomplish this, the arrangement of the blocking-lever, the first escapement wheel and the second escapement wheel is such that the force between the second escapement wheel and the blocking-lever 3 is substantially less than the force between the first escapement wheel and the second escapement wheel during phases of disengagement. More particularly, the arrangement of the blocking-lever, the first escapement wheel and the second escapement wheel is such that the force between the second escapement pinion 2*b* and the blocking-lever 3 is less than the force between the first escapement wheel 1*a* and the second escapement pinion 2*b*.

FIG. 1 illustrates a first resting position of the escapement device. In this figure, the plate 40 of the balance 4 turns in the counterclockwise direction, and the pallet-stone or the peg 40*a* for disengagement of the plate 40 of the balance 4 moves away from a fork 3*a* of the blocking-lever 3. A tooth 10*a* of the wheel 1*a*, under the effect of the torque produced by the motor means, exerts a force F2 on a resting surface 200*b* of a tooth 20*b* of the pinion 2*b*. The force F2, which passes essentially close to the axis A2, creates a torque which tends to make the second pinion 2*b* pivot in the counterclockwise direction, which engenders a bearing force F3 of a tooth 21*b* of the pinion 2*b* against a resting surface 30*b* of blocking means 3*b*, particularly a pallet-stone 3*b*, of the blocking-lever 3. The resting surface 30*b* is arranged such that the direction of the force F3 passes essentially through the axis A3. These forces are the same during the following disengagement phase, apart from the friction angles.

One notes that the angle α formed between the force vector F2 and the ray having as its origin the point of contact between the wheel 1*a* and the pinion 2*b* and passing through the axis A2 (or formed between the force vector F2 and a radial vector D with respect to the axis A2 and having as its origin the point of contact between the wheel 1*a* and the pinion 2*b*) is appreciably less than 50°, especially less than 30°, or less than 20°.

At rest, disregarding friction:

$$F3=F2\times(DO2/DO3)$$

with:

F2 and F3: the values of the intensities of the respective bearing forces against the surfaces 200*b* and 30*b;*

DO2: the value of the lever arm of the force F2 with respect to the axis A2;

DO3: the value of the lever arm of the force F3 with respect to the axis A2.

Given that DO2<<DO3, one thus notes that the intensity of the force F3 is appreciably less than the intensity of the force F2.

Figure 2:
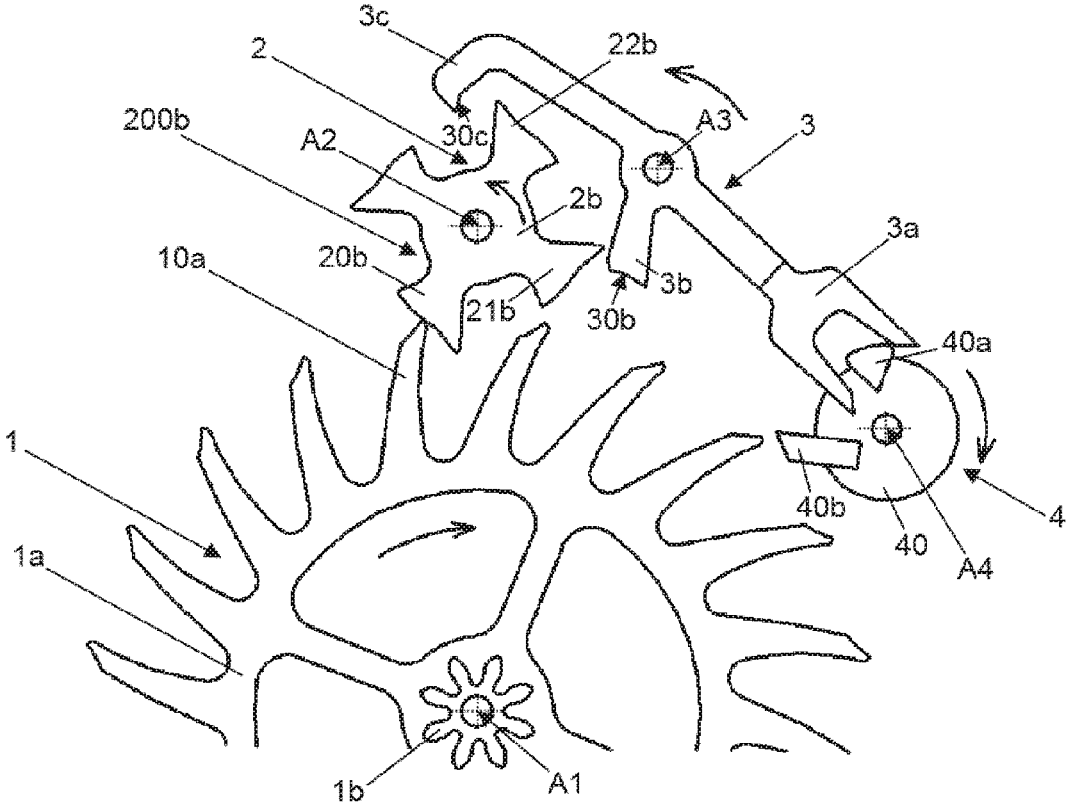
FIG. 2 is a view of the first variant of the first embodiment of the escapement in a second position.

FIG. 2 illustrates the escapement device just after the disengagement phase following the first resting position illustrated in FIG. 1. In FIG. 2, the plate 40 of the balance 4 turns in the clockwise direction. During the disengagement phase, the pallet-stone 40*a* for disengagement of the plate 40 of the balance 4 has come into contact with the fork 3*a* of the blocking-lever 3 and has caused the latter to pivot in the counterclockwise direction. This contact and this action are maintained in FIG. 2. This action has released the tooth 21*b* of the pinion 2*b* from the resting surface 30*b*. The energy furnished by the balance during this disengagement to overcome the friction and to place in motion the escapement wheels and the blocking-lever is appreciably less than that furnished in a conventional escapement device of the Robin type.

This slight energy expenditure is explained by the fact that the intensity of the force F3 is appreciably less than that of the bearing force F2. This intensity of the force F3 is minimized as much as possible if the inertias of the escapement wheels 1, 2 and the blocking-lever 3 are best minimized. Preferably, the total diameter D2*b* of the pinion 2*b* is reduced as much as possible in order to best reduce the inertia of the pinion 2*b*, as well as the dimensions of the blocking-lever 3. Thus, preferably, the total diameter D2*b* of the pinion 2*b* is appreciably less than the total diameter D1*a* of the first wheel 1*a*. For example, the total diameter D2*b* of the pinion 2*b* is less than 30% of the total diameter D1*a* of the first wheel 1*a*, or less than 20% of the total diameter D1*a* of the first wheel 1*a*.

After the disengagement phase, the pinion 2*b* turns in the counterclockwise direction. The tooth 22*b* of this pinion approaches the resting surface 30*c* of second blocking means 3*c* of the blocking-lever 3 and rests on this surface in a second resting position.

Figure 3:
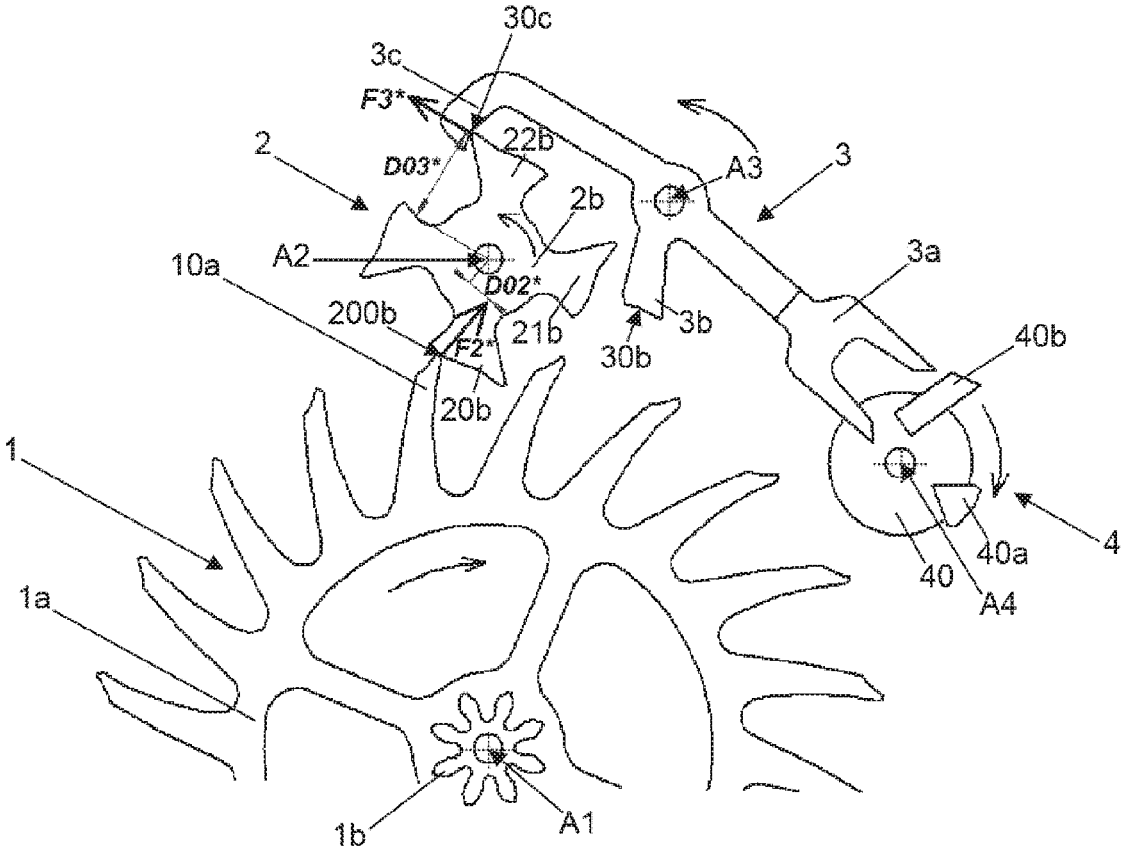
FIG. 3 is a view of the first variant of the first embodiment of the escapement in a third resting position.

FIG. 3 illustrates this second resting position. In this figure, the pallet-stone 40*a* of the plate 40 of the balance 4 moves away from the fork 3*a* of the blocking-lever 3. The tooth 10*a* of the wheel 1*a*, under the effect of the torque of the motor means, exerts a force F2* on the resting surface 200*b* of the tooth 20*b* of the pinion 2*b*. The force F2*, which passes essentially close to the axis A2, creates a torque which tends to make the pinion 2*b* pivot in the counterclockwise direction, which produces a bearing force F3* of the tooth 22*b* against the resting surface 30*c* of the pallet-stone 3*c* of the blocking-lever 3. The resting surface 30*c* is arranged such that the direction of the force F3* passes essentially through the axis A3. These forces are the same during the following disengagement phase, apart from the friction angles.

At rest, disregarding friction:

$$F3^*=F2^*\times(DO2^*/DO3^*)$$

with:

F2* and F3*: the values of the intensities of the respective bearing forces against the surfaces 200*b* and 30*c;*

DO2*: the value of the lever arm of the force F2* with respect to the axis A2;

DO3*: the value of the lever arm of the force F3* with respect to the axis A2.

Given that DO2*<<DO3*, one thus notes that the intensity of the force F3* is appreciably less than the intensity of the force F2*.

Figure 4:
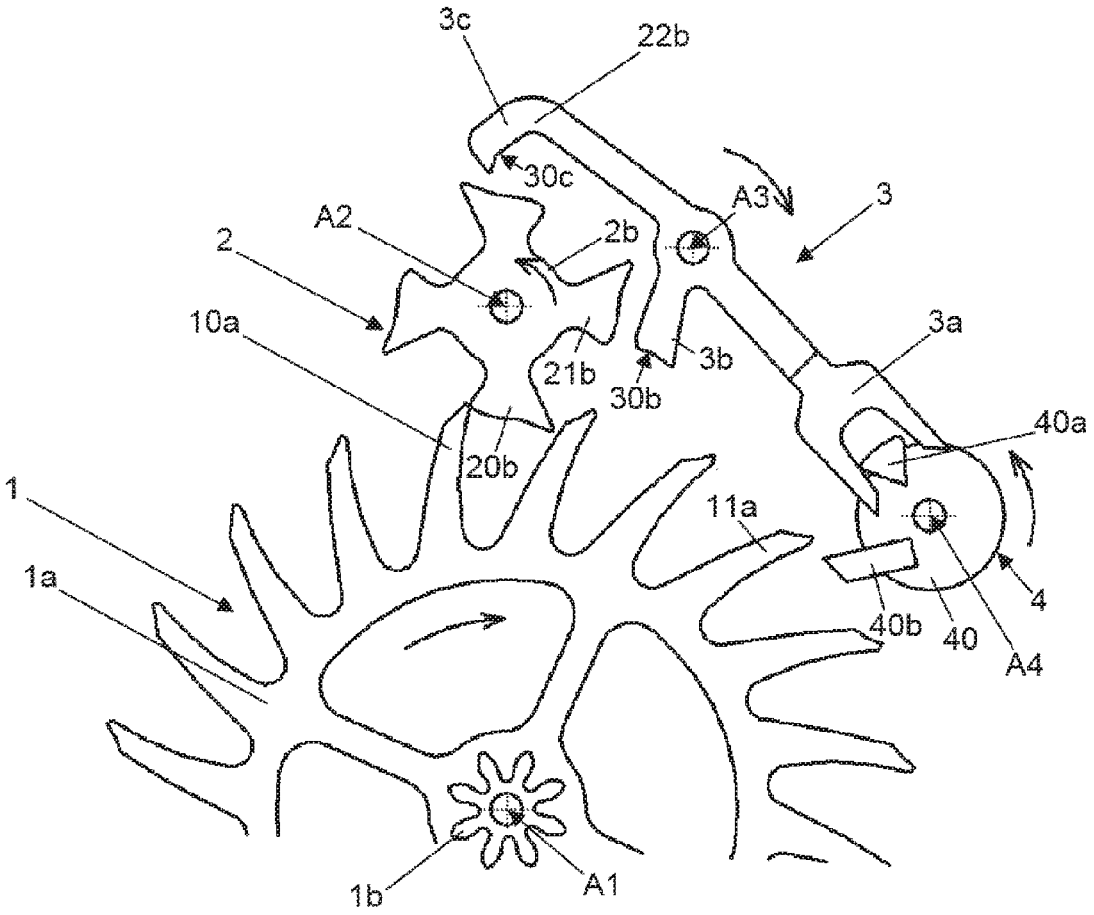
FIG. 4 is a view of the first variant of the first embodiment of the escapement in a fourth position.

FIG. 4 illustrates the escapement device just after the disengagement phase following the second resting position illustrated in FIG. 3. In FIG. 4, the plate of the balance turns in the counterclockwise direction. During the disengagement phase, the pallet-stone 40*a* for disengagement of the plate of the balance is in contact with the fork 3*a* of the blocking-lever 3 and causes the latter to turn clockwise. This contact and this action are maintained in FIG. 4. This action has released the tooth 22*b* of the pinion 2*b* from the resting surface 30*c*. For reasons similar to those described previously, the energy furnished by the balance during this disengagement to overcome the friction and to place in motion the escapement wheels and the blocking-lever is appreciably less than that furnished in a conventional escapement device of the Robin type.

After this disengagement, the first escapement wheel 1*a* accelerates and pushes, especially pushes tangentially, the second pinion 2*b* in the counterclockwise direction. At the same time, the tooth 11*a* of the escapement wheel approaches the impulse pallet-stone 40*b* of the plate of the balance to transmit the energy to the balance by the action of the tooth 11*a* on the pallet-stone 40*b* during an impulse phase. Preferably, the force transmitted from the tooth 11*a* to the pallet-stone 40*b* is essentially tangential with respect to the axes A1 and A4.

Figure 5:
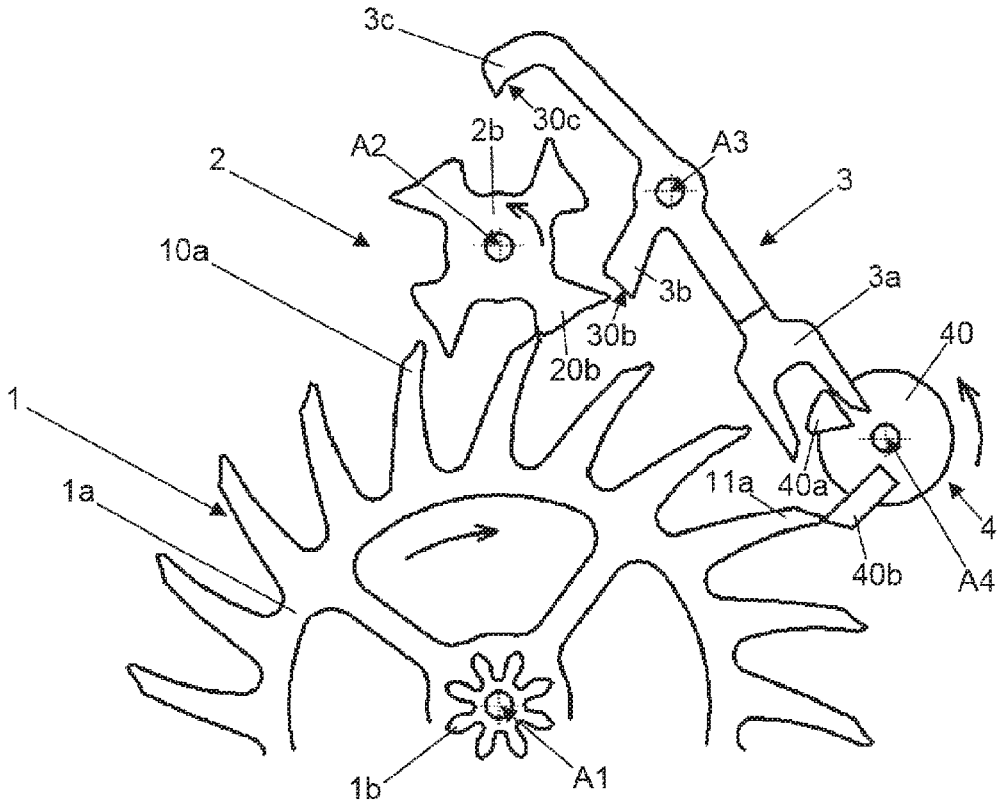
FIG. 5 is a view of the first variant of the first embodiment of the escapement in a fifth impulse position.

FIG. 5 illustrates the position of the escapement at the end of the impulse phase. In FIG. 5, the tooth 11*a* and the pallet-stone 40*b* are in contact by their respective ends and the tooth 20*b* of the pinion 2*b* approaches the resting surface 30*b* of the pallet-stone 3*b* of the blocking-lever 3. Once the tooth 20*b* comes into contact with the blocking-lever 3 and the tooth 10*a* comes into contact with the second escapement wheel 2, we are back at the configuration illustrated by FIG. 1.

The escapement device according to this variant of the first embodiment has a very high efficiency, since it allows on the one hand significantly reducing the energy furnished by the balance during the disengagement, and allows increasing on the other hand the efficiency of the energy transmission thanks to a direct impulse from the escapement wheel 1*a* to the balance, especially through a force transmitted from the first escapement wheel directly to the balance and which is essentially tangential. Another advantage of such an escapement device is the preservation, and thus the optimization, of the isochronism of the sprung balance due to the slight energy to be transmitted by the balance during the disengagement.

Figure 6:
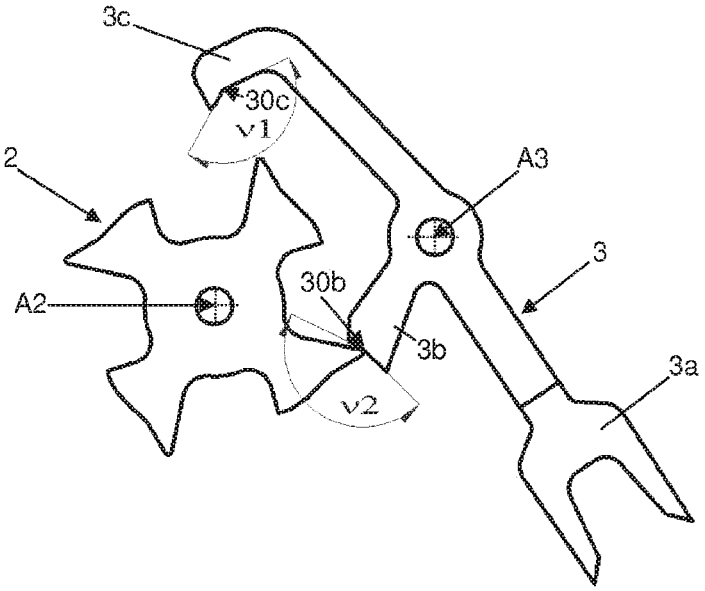
FIG. 6 is a detail view of a first variant of the blocking-lever of the first embodiment of the escapement.
Figure 7:
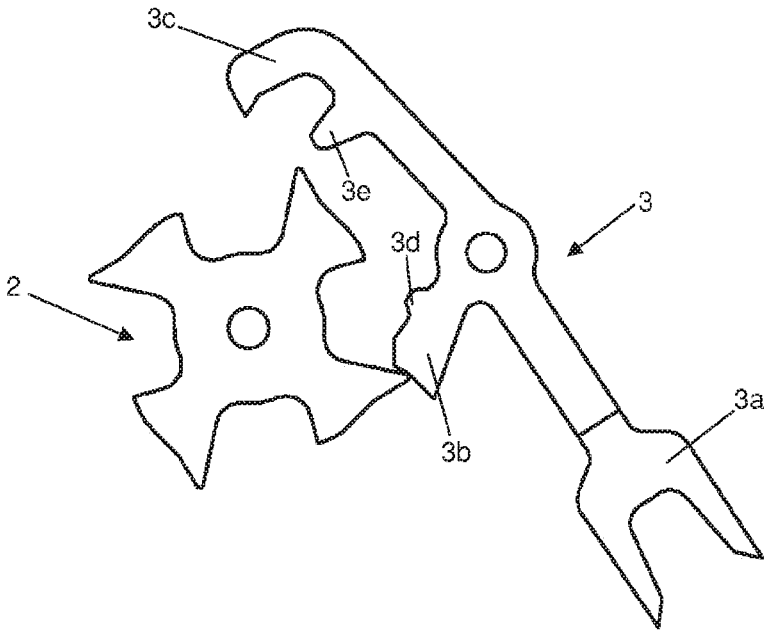
FIG. 7 is a detail view of a second variant of the blocking-lever of the first embodiment of the escapement.

Preferably, the resting surfaces 30*b*, 30*c* of the blocking means 3*b*, 3*c* of the blocking-lever 3 are concave shapes in order to guarantee the precision of positioning of the teeth 20*b* of the pinion 2*b* on these surfaces. For example, these concave surfaces may each be formed by two inclined planes making an angle preferably between 120° and 170°, as illustrated in FIG. 6.

In a second variant of the escapement device, the blocking-lever 3 may be also equipped with mechanical transmission means 3*d*, 3*e*, such as protuberances 3*d*, 3*e*, able to make the pinion 2*b* turn in the opposite direction to that of the first escapement wheel 1*a*, in addition to the forces F2, F2*. Thus, these transmission means may exert a complementary action to that of the forces F2 and F2* to make the second escapement wheel turn in the counterclockwise direction. The actions are for example exerted by the blocking-lever via the transmission means in the area of the resting surfaces of the second escapement wheel. One example of a blocking-lever of the escapement device according to the second variant is illustrated for example in FIG. 7.

Figure 8:
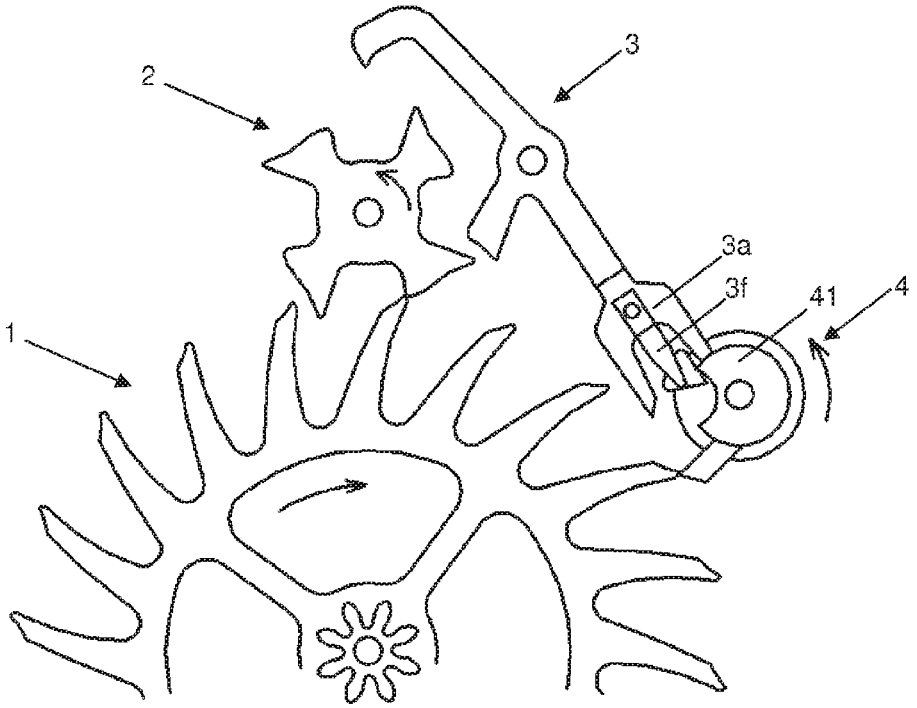
FIG. 8 is a detail view of a third variant of the blocking-lever of the first embodiment of the escapement.

In a third variant of the escapement device, the blocking-lever 3 may be also equipped with a safety-pin 3*f* designed to cooperate with a supplemental balance plate 41 as represented in FIG. 8, so as to prevent unwanted movements of the blocking-lever when subjected to a shock. This third variant may be combined with one or the other of the first and second variants.

In the different variants of the first embodiment, the geometries of the elements of the escapement may be as described below.

The first escapement wheel 1 comprises teeth 10*a*, in particular 20 teeth. The teeth are shaped as spikes. The teeth are oriented downstream (relative to their movement) in a direction making an angle between 20° and 45° with the radial direction with respect to the axis of the first escapement wheel. The free tip of each tooth may have the shape of a bevel.

The second escapement wheel 2 comprises teeth 20*b*, in particular 4 teeth. The teeth extend substantially for an angular sector of around 45°. Each tooth comprises a resting surface 200*b* oriented to make an angle β between 15° and 50°, or between 20° and 45°, with the orthoradial direction with respect to the axis A2 of the second escapement wheel. The angle β is an acute angle measured between the tangent to the resting surface and an orthoradial vector O2 with respect to the axis A2 and having as its origin the point of contact between the wheel 1*a* and the pinion 2*b*. This orientation makes it possible to create a slight torque tending to make the second escapement wheel turn against the blocking-lever in resting and disengagement phases. Each tooth is likewise bounded by at least one lateral surface 202*b* oriented substantially radially with respect to the axis A2.

The angles α and β are thus equal apart from the friction angle (friction angle in the area of the point of contact between the wheel 1*a* and the pinion 2*b*).

The blocking-lever 3 comprises resting surfaces 30*b*, 30*c*. The resting surfaces of the blocking-lever are oriented at least substantially orthoradially with respect to the axis A3.

In resting phase, one tip of a tooth 10*a* bears against a resting surface 200*b* of a tooth 20*b* of the second escapement wheel and one lateral surface 202*b* of another tooth 21*b* of the second escapement wheel bears against one or the other of the resting surfaces 30*b*, 30*c* of the blocking-lever.

Advantageously, in resting phase and in disengagement phase (while the second escapement wheel is bearing against the blocking-lever), a ray having as its origin the axis A2 of the second escapement wheel and passing through the first point of contact where the first force F2 of the first escapement wheel is applied to the second escapement wheel and a ray having as its origin the axis A2 of the second escapement wheel and passing through the axis A1 of the second escapement wheel make an angle greater than 10°, or greater than 20°, or greater than 30°.

Advantageously, and in supplemental or alternative manner, in resting phase and in disengagement phase (while the second escapement wheel is bearing against the blocking-lever), a ray having as its origin the axis A1 of the first escapement wheel and passing through the axis A2 of the second escapement wheel; and a ray having as its origin the axis A1 of the first escapement wheel and passing through the first point of contact where the first force F2 of the first escapement wheel is applied to the second escapement wheel make an angle greater than 5°, or greater than 10°, or greater than 20°.

A second embodiment of a timepiece 600', 600", 600* is described below with reference to FIGS. 9 to 15. The timepiece is for example a watch, in particular a wristwatch. The timepiece comprises a second embodiment of a watch movement 500', 500", 500*, in particular a mechanical movement. The movement comprises a second embodiment of an escapement device 400', 400", 400* situated between a wheelwork and an oscillator 4, 5.

The wheelwork is designed to connect a motor means, such as a barrel, to the escapement. The wheelwork thus enables a transmission of energy from the motor means to the escapement. As for the escapement, this makes it possible to furnish energy to the oscillator in order to maintain its oscillations.

The oscillator is for example an oscillator of the balance 4 and spring 5 type. The balance is pivoted about an axis A4', A4", A4*.

The escapement device 400', 400", 400* comprises primarily a first escapement wheel 1', 1", 1* pivoted about an axis A1', A1", A1*, a second escapement wheel 2', 2", 2* pivoted about an axis A2', A2", A2*, and a blocking-lever 3', 3", 3* pivoted about an axis A3', A3", A3*. The first escapement wheel, the second escapement wheel and the blocking-lever are configured and arranged such that, in a disengagement phase of the escapement device, a force of the blocking-lever controlled by the oscillator 4, 5 is transmitted to the first escapement wheel via the second escapement wheel.

The first escapement wheel comprises a first escapement wheel 1*a'*, 1*a"*, 1*a able to act indirectly on the timepiece oscillator. A first pinion 1***b'*, 1*b"*, 1*b of the geartrain is joined firmly in rotation with the first escapement wheel 1***a'*, 1*a"*, 1*a, in particular, it is secured to the first escapement wheel 1***a*, 1*a"*, 1*a, in particular, it is secured coaxially to the first escapement wheel 1***a'*, 1*a"*, 1*a. In the first variant, the escapement device is a direct-impulse escapement device, whose principle of operation is similar to that of a Robin type escapement device. This may be designed, for example, to cooperate with an oscillator of the balance 4 and spring 5** type.

In the second embodiment of the escapement device, the second escapement wheel comprises a second escapement pinion 2*b'*, 2*b"*, 2*b and a second wheel 2***a'*, 2*a"*, 2*a. The second wheel 2***a'*, 2*a"*, 2*a is joined firmly to the second escapement pinion 2***b'*, 2*b"*, 2*b, in particular the second wheel 2***a'*, 2*a"*, 2*a is secured to the second escapement pinion 2***b'*, 2*b"*, 2*b or vice versa. The blocking-lever cooperates with the second escapement pinion 2***b'*, 2*b"*, 2*b by way of the second escapement wheel 2***a'*, 2*a"*, 2*a, and vice versa. Like the escapement device according to the first embodiment, the second pinion 2***b'*, 2*b"*, 2*b is designed to cooperate directly with a first escapement wheel 1***a'*, 1*a"*, 1*a which is joined firmly in rotation with the first pinion 1***b'*, 1*b"*, 1*b** of the geartrain of the timepiece movement.

In the first variant of the second embodiment, the escapement device is of direct-impulse type. Its principle of operation is similar to that of a Robin type escapement device. This may be designed, for example, to cooperate with an oscillator of the sprung balance type.

In the first variant of the second embodiment, the escapement device is distinguished from that of the first embodiment by the fact that the impulse of the sprung balance is realized by a tooth 20*a'* of the second escapement wheel 2*a'*.

During the disengagement phase, the escapement device has an operation equivalent to that of the first embodiment.

In this first variant embodiment, the second wheel 2*a'* has the same number of teeth as the second pinion 2*b'*, namely, six teeth.

Figure 9:
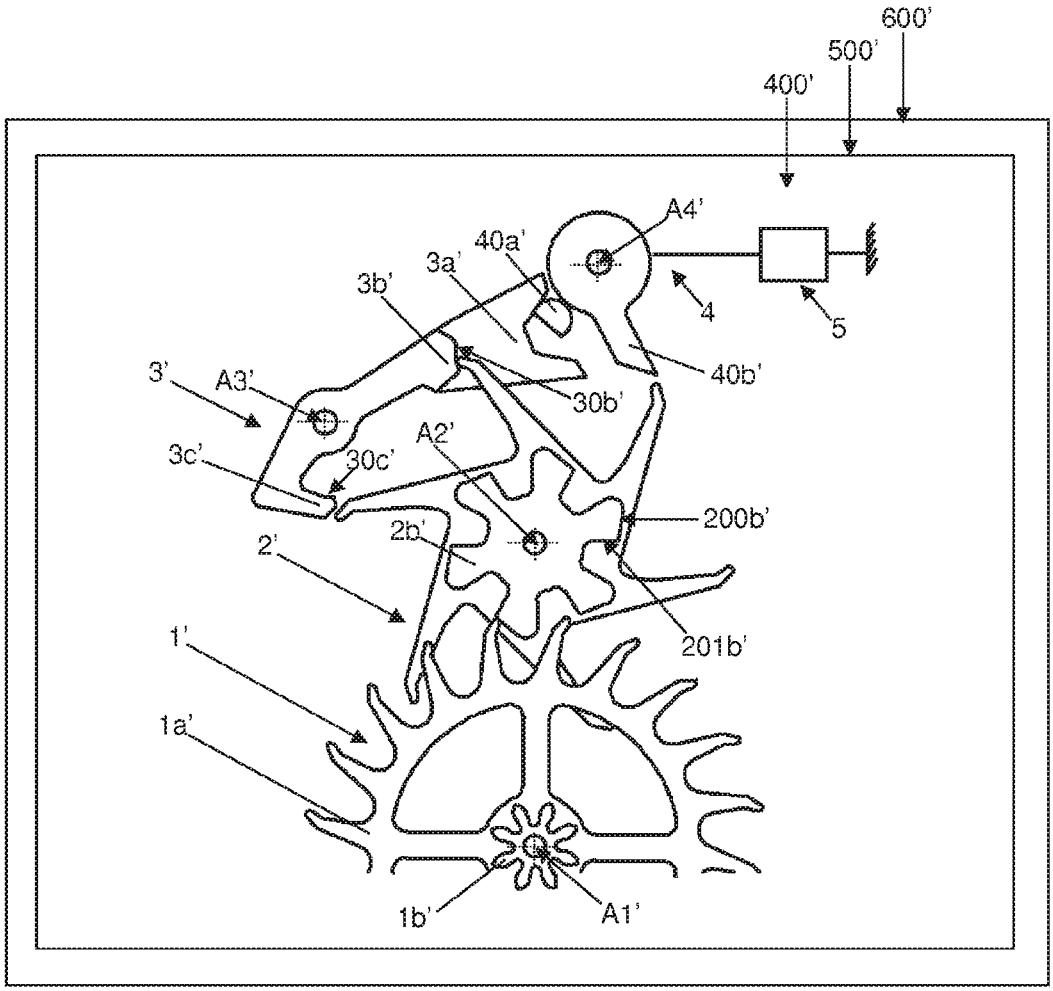
FIG. 9 is a schematic view of a first variant of a second embodiment of a timepiece according to the invention comprising a first variant of a second embodiment of an escapement in a first resting position.
Figure 10:
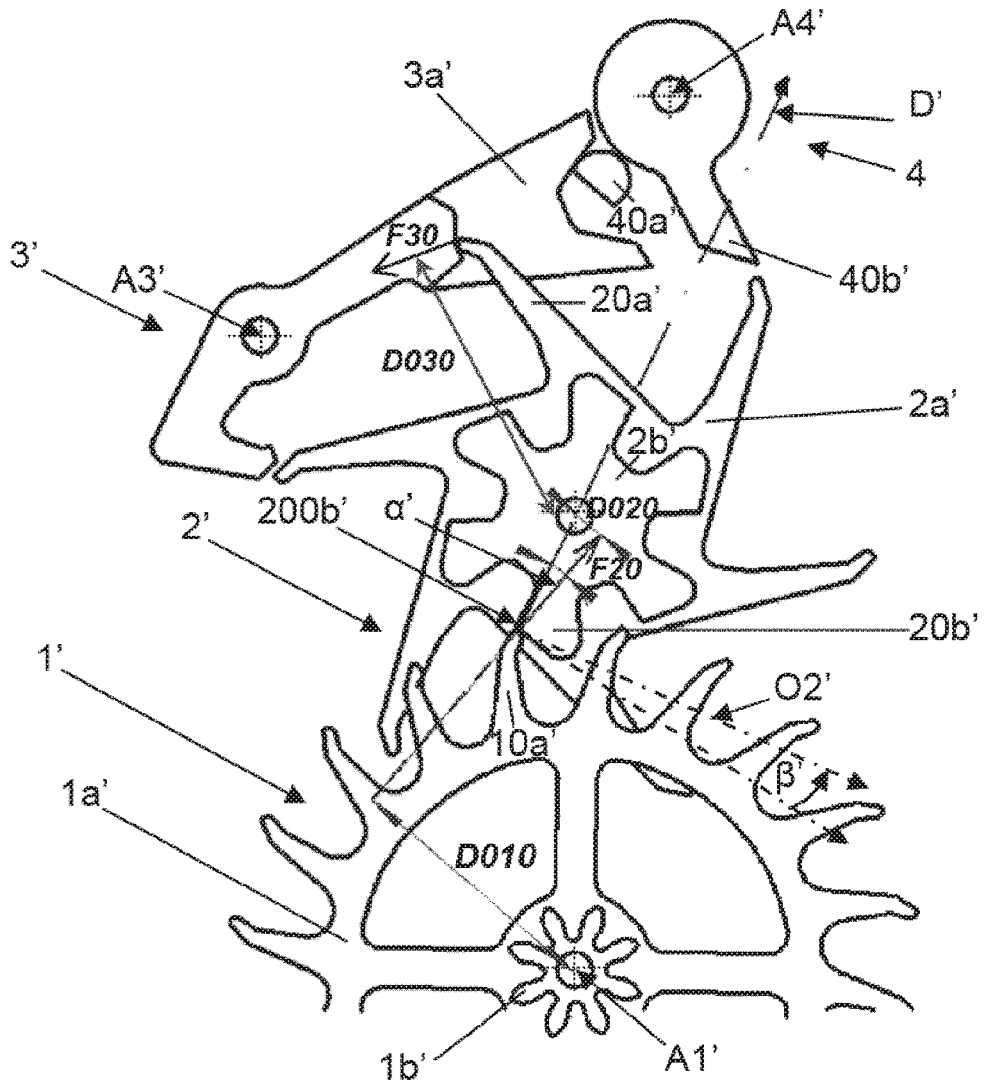
FIG. 10 is a view identical to FIG. 9 in which the contact forces are represented.

FIG. 9 illustrates a resting position of such an escapement device, similar to that of the device according to the first embodiment illustrated in FIG. 3, preceding a disengagement phase.

The tooth 10*a'* of the wheel 1*a'*, under the effect of the torque of the motor means, exerts a force F20 on a resting surface 200*b'* of the tooth 20*b'* of the pinion 2*b'*. The force F20, which passes essentially close to the axis A2', creates a torque which tends to make the pinion 2*b'* pivot in the counterclockwise direction, which produces a bearing force F30 of a tooth 20*a'* against a resting surface 30*c'* of blocking means 3*c'* of the blocking-lever 3. The resting surface 30*c'* is arranged such that the direction of the force F30 passes essentially through the axis A3'. These forces are the same during the following disengagement phase, apart from the friction angles.

At rest, disregarding friction:

$$F30=F20\times(DO20/DO30)$$

with:

F20 and F30: the values of the intensities of the respective bearing forces against the surfaces 200*b*' and 30*c*';

DO20: the value of the lever arm of the force F20 with respect to the axis A2';

DO30: the value of the lever arm of the force F30 with respect to the axis A2'.

Given that DO20<<DO30, one thus notes that the intensity of the force F30 is appreciably less than the intensity of the force F20.

The energy furnished by the balance during the disengagement phase to overcome the friction and to place in motion the escapement wheels and the blocking-lever is appreciably less than that furnished in a conventional escapement device of the Robin type.

This slight energy expenditure is explained by the fact that the intensity of the force F30 is appreciably less than that of the bearing force F20.

One notes here as well that the angle α' formed between the force vector F20 and the ray having as its origin the point of contact between the wheel 1*a*' and the pinion 2*b*' and passing through the axis A2' (or formed between the force vector F20 and a radial vector D' with respect to the axis A2' and having as its origin the point of contact between the wheel 1*a*' and the pinion 2*b*') is appreciably less than 50°, or less than 30°, or less than 20°.

This intensity of the force F30 is minimized as much as possible if the inertias of the escapement wheels 1', 2' and the blocking-lever 3' are best minimized. Preferably, the total diameter D2*b*' of the pinion 2*b*' is reduced as much as possible in order to best reduce the inertia of the pinion 2*b*', as well as the dimensions of the blocking-lever 3'. Thus, preferably, the total diameter D2*b*' of the pinion 2*b*' is appreciably less than the total diameter D1*a*' of the first wheel 1*a*', in particular less than 50%, or less than 40%, of the total diameter D1*a*' of the first wheel 1*a'*.

The tooth profile of the elements 1*a*' and 2*b*' may likewise be configured such that the torque transmitted by the first wheel 1*a*' to the second pinion 2*b*' during the impulse phase is appreciably greater than that transmitted during the disengagement.

Figure 11:
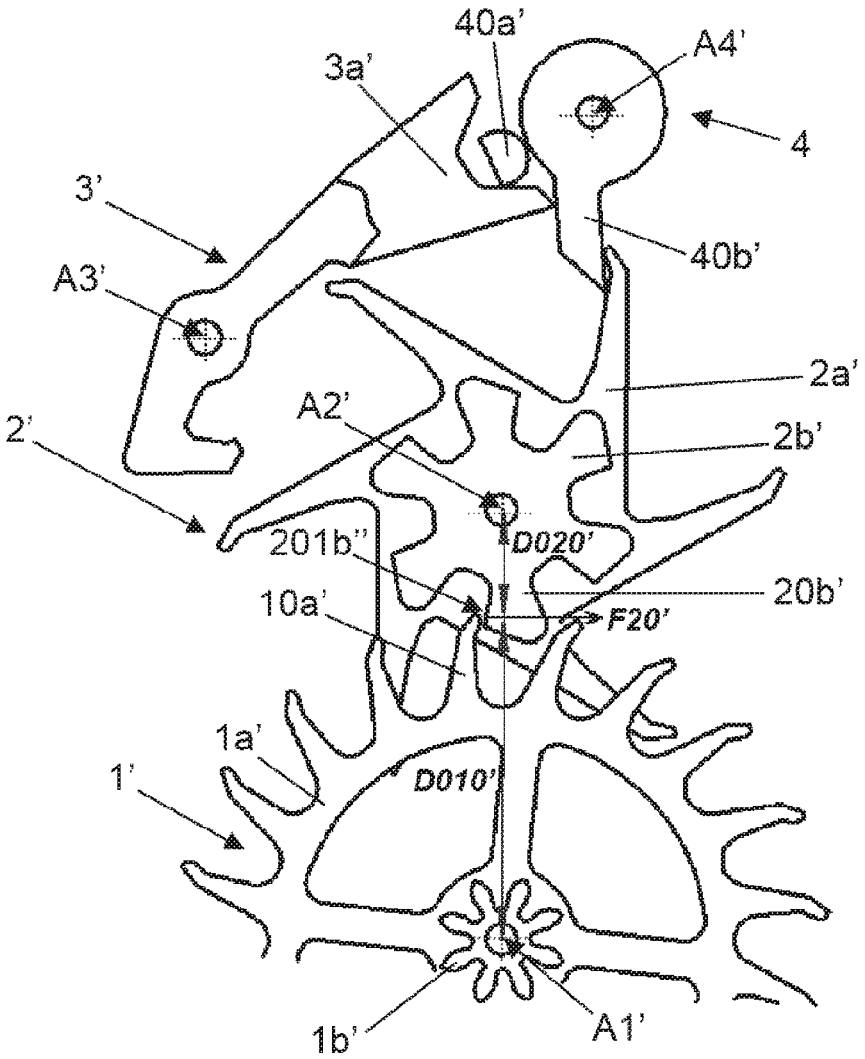
FIG. 11 is a view of the first variant of the second embodiment of the escapement in a second impulse position.

During the beginning of the disengagement phase following the resting phase as illustrated in FIG. 9, the torque C2*d* in the area of the pinion 2*b*' may be expressed as follows with regard to the torque C1*d* in the area of the wheel 1*a*', and disregarding friction:

$$C2d=C1d\times(DO20/DO10)$$

with:

DO10: the value of the lever arm of the force F20 with respect to the axis A1';

DO20: the value of the lever arm of the force F20 with respect to the axis A2';

Upon beginning of the impulse phase as illustrated in FIG. 11, an impulse surface 201*b*" of the second pinion 2*b*' is oriented such that the force F20' transmitted is essentially tangential to the trajectory of the point of contact between the wheel 1*a*' and the pinion 2*b*'. In other words, upon beginning of the impulse phase, the force F20' is essentially normal to the ray having as its origin the axis A1' and passing through the axis A2'.

Upon beginning of this impulse phase, the torque C2*i* in the area of the pinion 2*b*' may be expressed as follows in relation to the torque C1*i* in the area of the wheel 1*a*', and disregarding friction:

$$C2i=C1i\times(DO20'/DO10')$$

with:

DO10': the value of the lever arm of the force F20' with respect to the axis A1';

DO20': the value of the lever arm of the force F20' with respect to the axis A2'.

Given that:

$$DO20/DO10<<DO20'/DO10' \text{ and that } C1d=C1i$$

The torque C2*i* transmitted to the pinion 2*b*' during the impulse phase is appreciably greater than the torque C2*d* transmitted to the pinion 2*b*' during the disengagement phase. Thus, the energy to be furnished by the balance during the disengagement phase is minimized and the energy transmitted by the motor means during the impulse phase to the escapement device is maximized. Such an escapement device thus has the advantage of having an efficiency which is maximized as compared to escapement devices known in the prior art, on the order of 120 to 160% as compared to the mean reference efficiencies on the order of 30 to 40%. Such a device also has the advantage of minimizing the perturbations of the oscillator, and thus allows the implementing of an oscillator with optimized isochronism as compared to oscillators cooperating with escapement devices known in the prior art.

In the first variant of the second embodiment, the geometries of the elements of the escapement may be as described below.

The first escapement wheel 1' comprises teeth 10*a*', in particular 20 teeth. The teeth are oriented downstream (relative to their movement) in a direction making for example an angle between 20° and 45° with the radial direction with respect to the axis A1' of the first escapement wheel. The free tip of each tooth may have the shape of a bevel.

The second escapement pinion 2*b*' comprises teeth 20*b*', in particular 6 teeth. The teeth extend substantially for an angular sector of around 30°. Each tooth comprises a resting surface 200*b*' oriented to make an angle β' between 15° and 50°, or between 20° and 45°, with the orthoradial direction O2' with respect to the axis A2' of the second escapement wheel. The angle β' is an acute angle measured between the tangent to the resting surface and an orthoradial vector O2' with respect to the axis A2' and having as its origin the point of contact between the wheel 1*a*' and the pinion 2*b*'. This orientation makes it possible to create a slight torque tending to make the second escapement wheel turn against the blocking-lever in resting and disengagement phases. Each tooth is likewise bounded by at least one lateral surface oriented substantially radially with respect to the axis A2'. This at least one lateral surface is an impulse surface 201*b'*.

The angles α' and β' are thus equal apart from the friction angle (friction angle in the area of the point of contact between the wheel 1*a*' and the pinion 2*b*').

The blocking-lever 3 comprises resting surfaces 30*b*', 30*c*'. The resting surfaces are oriented at least substantially orthoradially with respect to the axis A3' of the blocking-lever.

In resting phase, one tip of a tooth 10*a*' bears against a resting surface 200*b*' of a tooth 20*b*' of the second escapement wheel and one tip of a tooth 20*a*' of the second escapement wheel bears against a resting surface 30*b*', 30*c*' of the blocking-lever.

Advantageously, in resting phase and in disengagement phase (while the second escapement wheel is bearing against the blocking-lever), a ray having as its origin the axis A2' of the second escapement wheel and passing through the first point of contact where the first force F20 of the first escapement wheel is applied to the second escapement wheel and a ray having as its origin the axis A2' of the second escapement wheel and passing through the axis A1' of the second escapement wheel make an angle greater than 10°, or greater than 20°, or greater than 30°.

Advantageously, and in supplemental or alternative manner, in resting phase and in disengagement phase (while the second escapement wheel is bearing against the blocking-lever), a ray having as its origin the axis A1' of the first escapement wheel and passing through the axis A2' of the second escapement wheel; and a ray having as its origin the axis A1' of the first escapement wheel and passing through the first point of contact where the first force F20 of the first escapement wheel is applied to the second escapement wheel make an angle greater than 5°, or greater than 10°, or greater than 20°.

Figure 12:
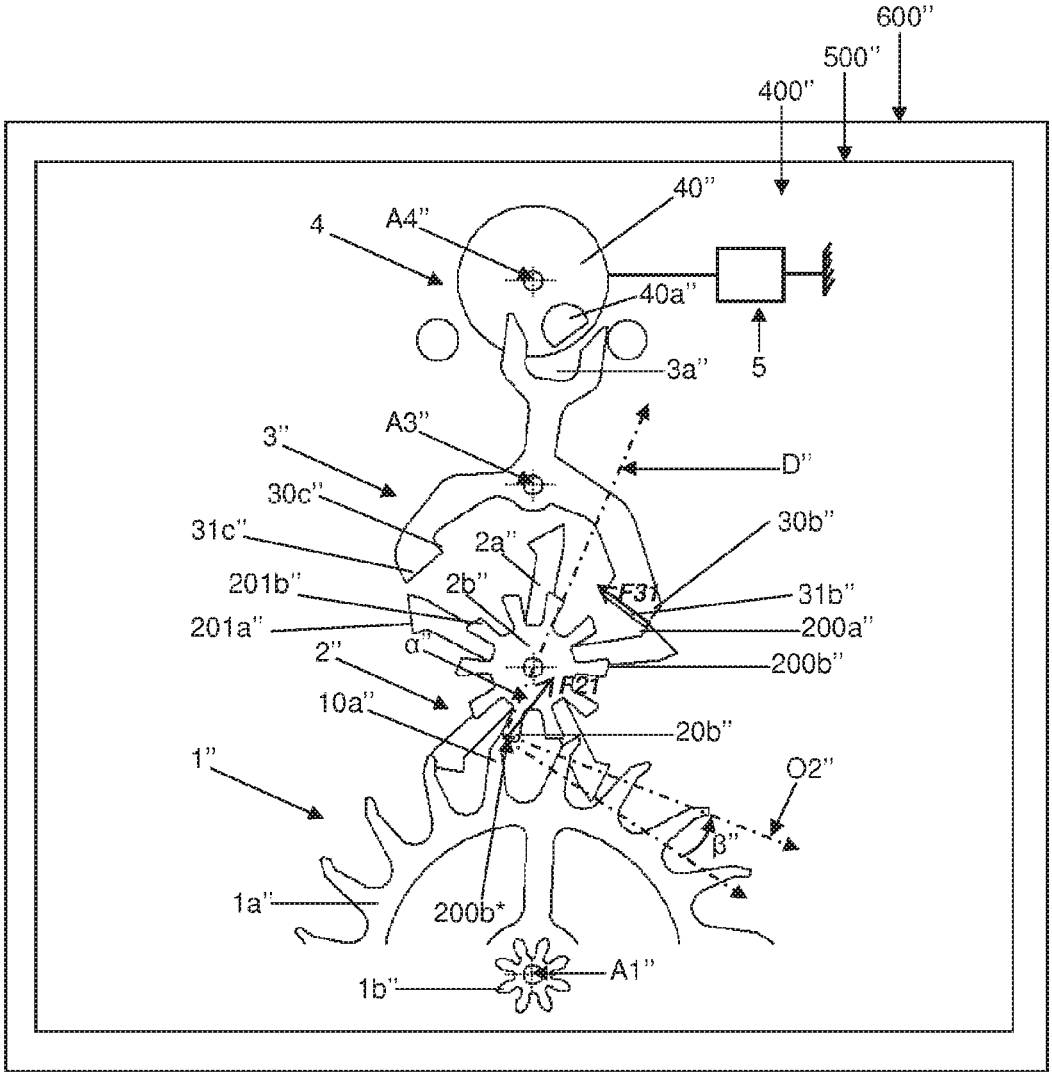
FIG. 12 is a schematic view of a second variant of the second embodiment of a timepiece according to the invention comprising a second variant of the second embodiment of an escapement in a first resting position.
Figure 13:
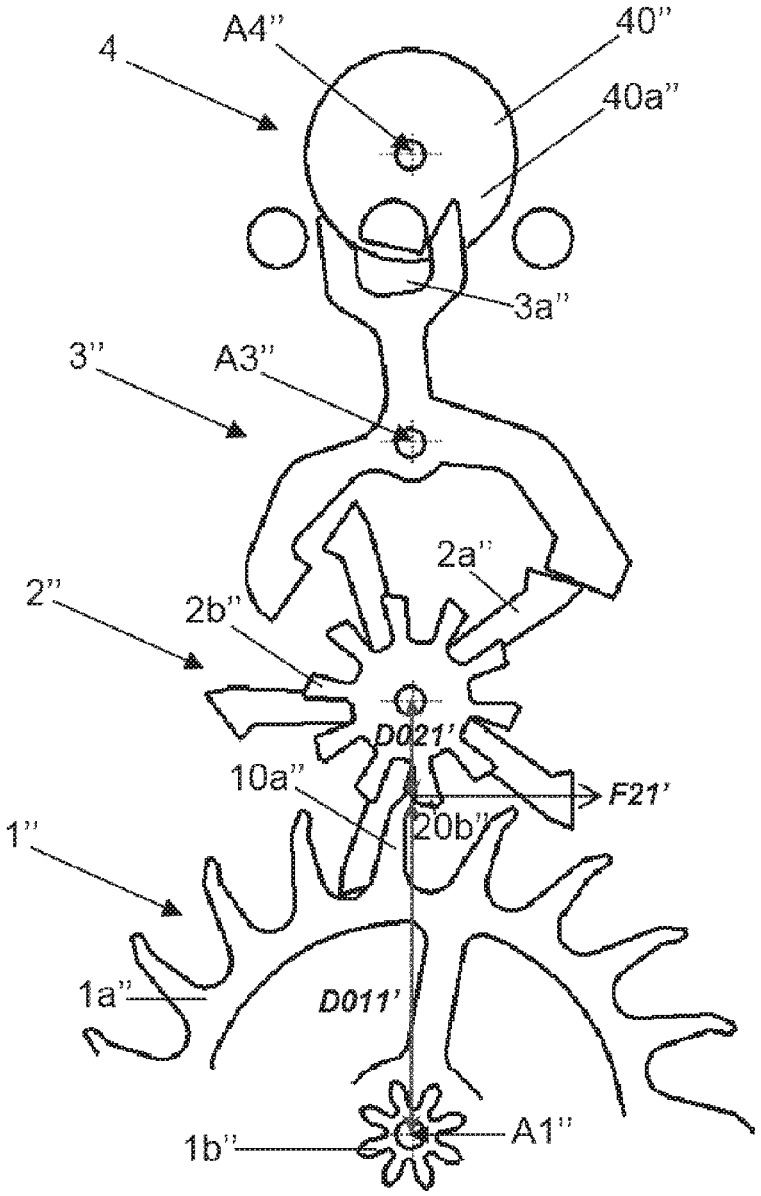
FIG. 13 is a view of the second variant of the second embodiment of the escapement in a second impulse position.

In a second variant of the second embodiment, as represented in FIGS. 12 and 13, the escapement device is of the indirect-impulse type. Its general operating principle is similar to that of a Swiss lever type escapement device. The escapement device according to the second variant of the second embodiment may be designed, for example, to cooperate with an oscillator of the sprung balance type.

Such an escapement device is distinguished from that of the first variant of the second embodiment by the fact that the impulse of the sprung balance is accomplished by means of a blocking-lever 3" whose fork 3*a*" is designed to cooperate exclusively with a balance 4", in particular a plate 40" of the balance, especially a peg 40*a*" of the plate of the balance.

FIG. 12 illustrates a resting position of such an escapement device prior to a disengagement phase.

A tooth 10*a*" of the wheel 1*a*", under the effect of the torque of the motor means, exerts a force F21 on a resting surface 200*b*" of a tooth 20*b*" of the pinion 2*b*". The force F21, which passes essentially close to the axis A2", creates a torque which tends to make the pinion 2*b*" pivot in the counterclockwise direction, which produces a bearing force F31 of a tooth 20*a*" against a resting surface 30*c*" of blocking means 3*c*" of the blocking-lever 3". The resting surface 30*c*" is arranged such that the direction of the force F31 passes essentially through the axis A3". These forces are the same during the following disengagement phase, apart from the friction angles.

At rest, disregarding friction:

$$F31=F21\times(DO21/DO31)$$

with:

F21: the value of the intensity of the bearing force against the surface 200*b*";

F31: the value of the intensity of the bearing force against the surface 30*c*";

DO21: the value of the lever arm of the force F21 with respect to the axis A2";

DO31: the value of the lever arm of the force F31 with respect to the axis A2".

Given that DO21<<DO31, one notes that the intensity of the force F31 is appreciably less than the intensity of the force F21.

The energy furnished by the balance during the disengagement to overcome the friction and to place in motion the escapement wheels and the blocking-lever is thus appreciably less than that furnished in a conventional escapement device of the Swiss lever type.

This slight energy expenditure is explained by the fact that the intensity of the force F31 is appreciably less than that of the bearing force F21.

One notes here as well that the angle α" formed between the force vector F21 and the ray having as its origin the point of contact between the wheel 1*a*" and the pinion 2*b*" and passing through the axis A2" (or formed between the force vector F21 and a radial vector D" with respect to the axis A2" and having as its origin the point of contact between the wheel 1*a*" and the pinion 2*b*") is appreciably less than 50°, or less than 30°, or less than 20°.

This intensity of the force F31 is minimized as much as possible if the inertias of the escapement wheels 1", 2" and the blocking-lever 3" are best minimized. Preferably, the total diameter D2*b*" of the pinion 2*b*" is reduced as much as possible in order to best reduce the inertia of the pinion 2*b*", as well as the dimensions of the blocking-lever 3". Thus, preferably, the total diameter D2*b*" of the pinion 2*b*" is appreciably less than the total diameter D1*a*" of the first wheel 1*a*", in particular less than 60% of the total diameter D1*a*" of the first escapement wheel 1*a*", or less than 50% of the total diameter D1*a*" of the first escapement wheel 1*a*".

The toothing profile of the elements 1*a*" and 2*b*" may likewise be configured such that the torque transmitted by the first wheel 1*a*" to the second pinion 2*b*" during the impulse phase is appreciably greater than that transmitted during the disengagement.

During the beginning of the disengagement phase following the resting phase as illustrated in FIG. 12, the torque C2*d*' in the area of the pinion 2*b*" may be expressed as follows with regard to the torque C1*d*' in the area of the wheel 1*a*", and disregarding friction:

$$C2d'=C1d'\times(DO21/DO11)$$

with:

DO11: the value of the lever arm of the force F21 with respect to the axis A1";

DO21: the value of the lever arm of the force F21 with respect to the axis A2".

Upon beginning of the impulse phase, not represented, an impulse surface 201*b*" of the second pinion 2*b*" is oriented such that the force F21' transmitted by the first escapement wheel to the second escapement wheel is essentially tangential to the trajectory of the point of contact between the wheel 1*a*" and the pinion 2*b*". In other words, upon beginning of the impulse phase, the force F21' is essentially normal to the ray having as its origin the axis A1" and passing through the axis A2".

Upon beginning of this impulse phase, the torque C2*i*' in the area of the pinion 2*b*" may be expressed as follows in relation to the torque C1*i*' in the area of the wheel 1*a*", and disregarding friction:

$$C2i'=C1i'\times(DO21'/DO11')$$

with:

DO11': the value of the lever arm of the force F21' with respect to the axis A1";

DO21': the value of the lever arm of the force F21' with respect to the axis A2".

Given that:

$$DO21/DO11<<DO21'/DO11' \text{ and that } C1i'=C1d'$$

The torque C2*i*' transmitted to the pinion 2*b*" during the impulse phase is appreciably greater than the torque C2*d*' transmitted to the pinion 2*b*" during the disengagement phase. Thus, the energy to be furnished by the balance during the disengagement phase is minimized and the energy transmitted by the motor means during the impulse phase to the escapement device is maximized. Such an escapement device thus has the advantage of having an efficiency which is maximized as compared to escapement devices known in the prior art, on the order of 120 to 160% as compared to the mean reference efficiencies on the order of 30 to 40%. Such a device also has the advantage of minimizing the perturbations at the oscillator, and thus allows the implementing of an oscillator with optimized isochronism as compared to oscillators cooperating with escapement devices known in the prior art.

In the second variant of the second embodiment, the geometries of the elements of the escapement may be as described below.

The first escapement wheel 1" comprises teeth 10*a*", in particular 20 teeth. The teeth are oriented downstream (relative to their movement) in a direction making for example an angle between 20° and 45° with the radial direction with respect to the axis A1" of the first escapement wheel. The free tip of each tooth may have the shape of a bevel.

The second escapement pinion 2*b*" comprises teeth 20*b*", in particular 10 teeth. The teeth extend substantially for an angular sector of around 10°. Each tooth comprises a resting surface 200*b*" oriented to make an angle β" between 15° and 50°, or between 20° and 45°, with the orthoradial direction O2" with respect to the axis A2" of the second escapement wheel. The angle β" is an acute angle measured between the tangent to the resting surface and an orthoradial vector O2" with respect to the axis A2" and having as its origin the point of contact between the wheel 1*a* and the pinion 2*b*. This orientation makes it possible to create a slight torque tending to make the second escapement wheel turn against the blocking-lever in resting and disengagement phases. Each tooth is likewise bounded by two lateral surfaces oriented substantially radially with respect to the axis A2". One of these two lateral surfaces is an impulse surface 201*b"*.

The angles α" and β" are thus equal apart from the friction angle (friction angle in the area of the point of contact between the wheel 1*a*" and the pinion 2*b*").

The second escapement wheel 2*a*" comprises teeth 20*a*", in particular 5 teeth. The teeth are shaped as arms. Each tooth comprises a resting surface 200*a*" oriented at least essentially radially with respect to the axis A3" of the blocking-lever when this tooth of the second wheel is in contact with the blocking-lever. Each tooth is likewise bounded by an impulse surface 201*a*" oriented at least essentially orthoradially with respect to the axis A3" of the blocking-lever when this tooth of the second wheel is in contact with the blocking-lever.

The blocking-lever 3 comprises the resting surfaces 30*b*", 30*c*" oriented at least substantially orthoradially with respect to the axis A3" of the blocking-lever and impulse surfaces 31*b*", 31*c*" oriented at least substantially radially with respect to the axis A3" of the blocking-lever.

In resting and disengagement phases, one tip of a tooth 10*a*" bears against a resting surface 200*b*" of a tooth 20*b*" of the second pinion and one resting surface 200*a*" of a tooth 20*a*" of the second wheel bears against a resting surface 30*b*", 30*c*" of the blocking-lever.

Advantageously, in resting phase and in disengagement phase (while the second escapement wheel is bearing against the blocking-lever), a ray having as its origin the axis A2" of the second escapement wheel and passing through the first point of contact where the first force F21 of the first escapement wheel is applied to the second escapement wheel and a ray having as its origin the axis A2" of the second escapement wheel and passing through the axis A"1 of the second escapement wheel make an angle greater than 10°, or greater than 20°, or greater than 30°.

Advantageously, and in supplemental or alternative manner, in resting phase and in disengagement phase (while the second escapement wheel is bearing against the blocking-lever), a ray having as its origin the axis A1" of the first escapement wheel and passing through the axis A2" of the second escapement wheel; and a ray having as its origin the axis A1" of the first escapement wheel and passing through the first point of contact where the first force F21 of the first escapement wheel is applied to the second escapement wheel make an angle greater than 5°, or greater than 10°, or greater than 20°.

In impulse phase, one tip of a tooth 10*a*" bears against an impulse surface 201*b*" of a tooth 20*b*" of the second pinion and an impulse surface 201*a*" of a tooth 20*a*" of the second wheel bears against an impulse surface 31*b*" of the blocking-lever.

Figure 14:
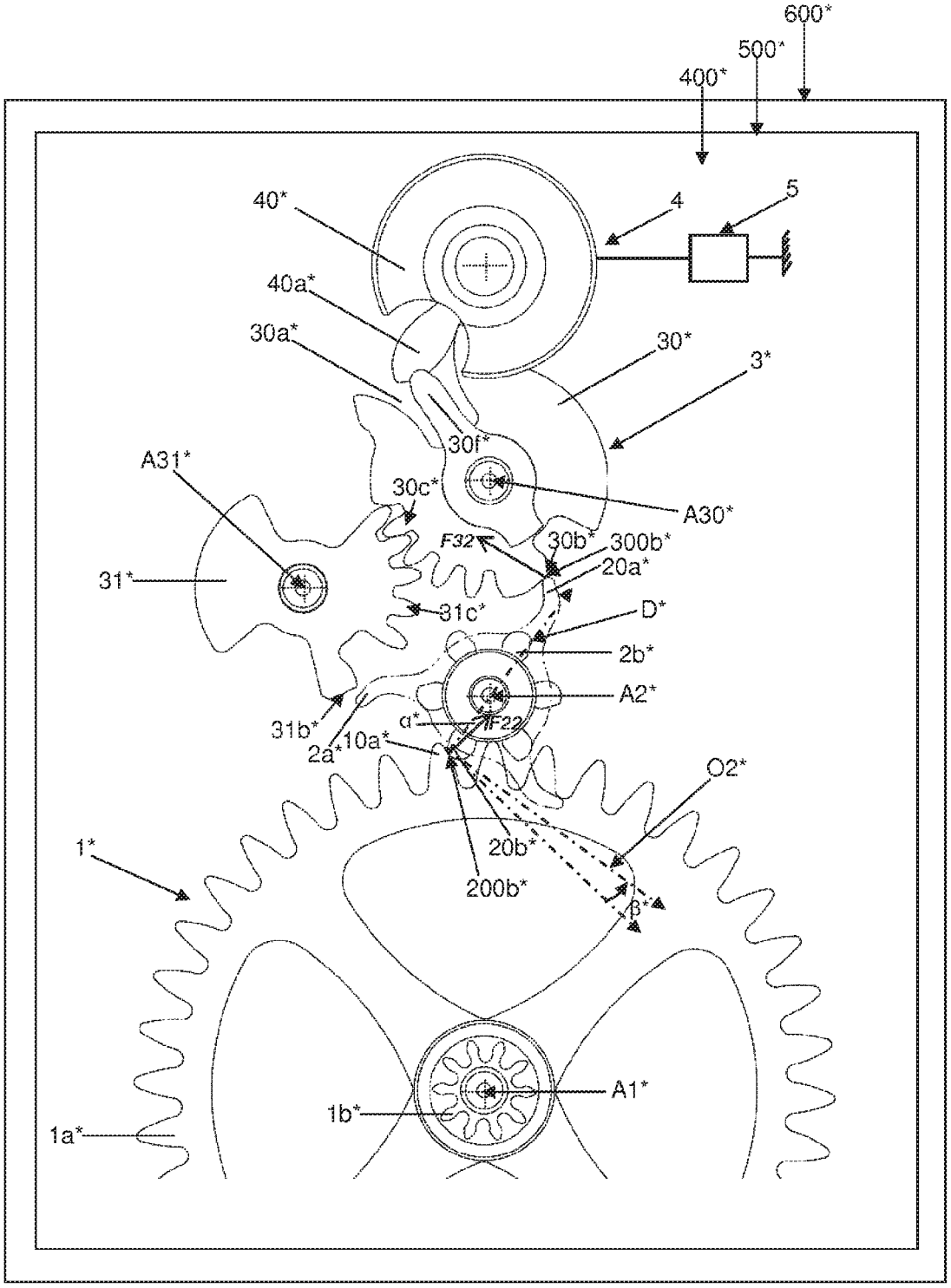
FIG. 14 is a schematic view of a third variant of the second embodiment of a timepiece according to the invention comprising a third variant of the second embodiment of an escapement in a first resting position.
Figure 15:
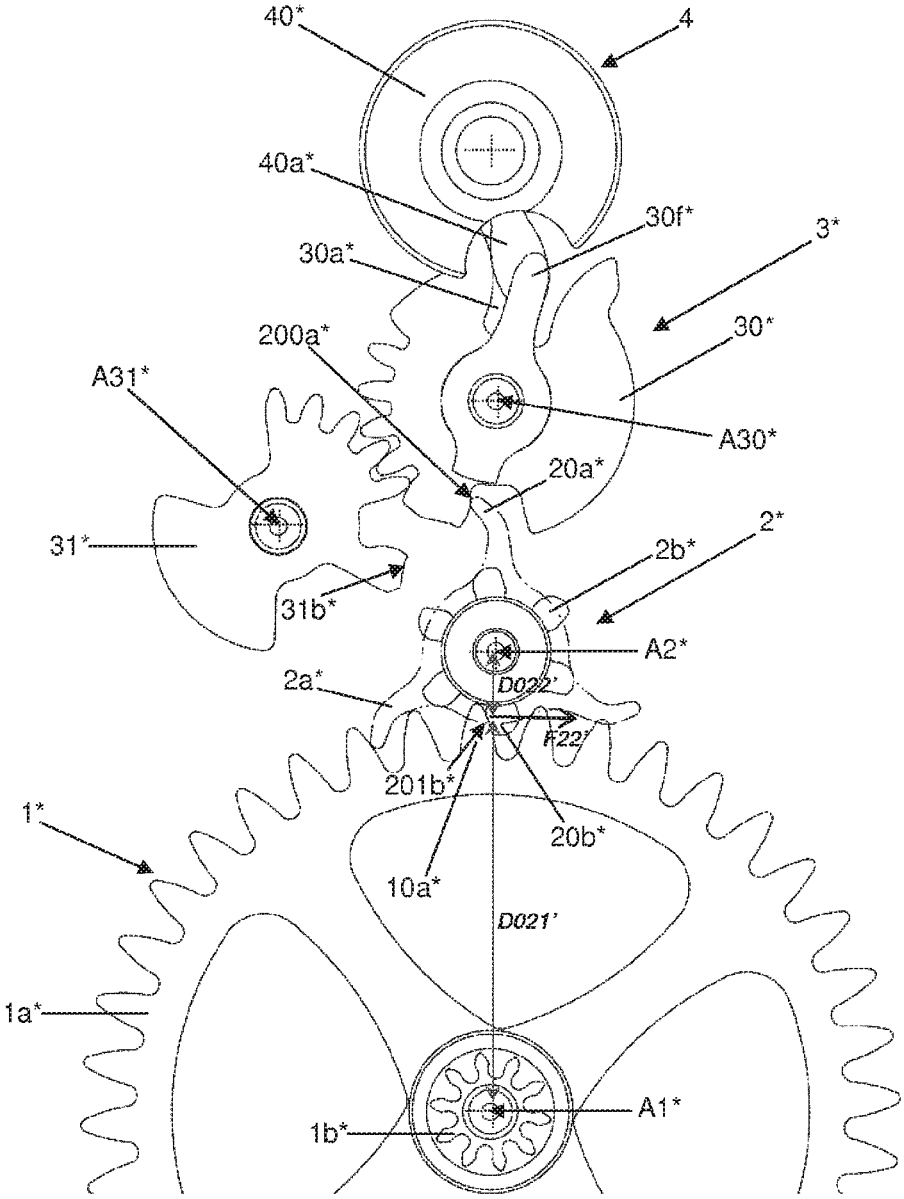
FIG. 15 is a view of the third variant of the second embodiment of the escapement in a second impulse position.

In a third variant of the second embodiment, represented in FIGS. 14 and 15, the escapement device has an operating principle similar to that of the device disclosed in patent application WO2013182243A1.

The latter is designed, for example, to cooperate with an oscillator of the sprung balance type.

This is an escapement device of indirect impulse type. Thus, the impulse of the sprung balance is accomplished by means of a blocking-lever 3* one fork 30*a of which is designed to cooperate exclusively with a balance 4, especially a plate 40* of the balance, in particular a peg 40*a of the plate of the balance. Such an escapement device is distinguished from previous variant embodiments by the fact that the blocking-lever 3* is made of two distinct pieces 30*, 31* kinematically linked to each other. The first piece 30* is pivoted about an axis A30*. The first piece 30* comprises the fork 30*a, blocking means 30*b designed to act by contact with a toothing 20*a of the second wheel 2*a, as well as a toothing 30*c which is designed to mesh with a toothing 31*c of the second piece 31*. The second piece 31* is pivoted about an axis A31*. The second piece 31* likewise comprises blocking means 31*b designed to act by contact with the toothing 20*a of the second wheel 2*a**.

FIG. 14 illustrates a resting position of such an escapement device prior to a disengagement phase.

One tooth 10*a of the wheel 1*a, under the effect of the torque of the motor means, exerts a force F22 on a resting surface 200*b of a tooth 20*b of the pinion 2*b. The force F22 passes essentially close to the axis A2*. The force F22 creates a torque which tends to make the pinion 2*b pivot in the counterclockwise direction, which produces a bearing force F32 of a tooth 20*a against a resting surface 300*b of the blocking means 30*b of the portion 30* of the blocking-lever 3*. The resting surface 300*b is arranged such that the direction of the force F32 passes essentially through the axis A30*. These forces are the same during the following disengagement phase, apart from the friction angles.

At rest, disregarding friction:

$$F32=F22\times(DO22/DO32)$$

with:

F22: the value of the intensity of the bearing force against the surface 200*b**;

F32: the value of the intensity of the bearing force against the surface 300*b**;

DO22: the value of the lever arm of the force F22 with respect to the axis A2*;

DO32: the value of the lever arm of the force F32 with respect to the axis A2*.

Given that DO22<<DO32, one thus notes that the intensity of the force F32 is appreciably less than the intensity of the force F22.

The energy furnished by the balance during the disengagement to overcome the friction and to place in motion the escapement wheels and the blocking-lever is appreciably less than that furnished in a conventional escapement device of the Swiss lever type.

This slight energy expenditure is explained by the fact that the intensity of the force F32 is appreciably less than that of the bearing force F22.

One notes here as well that the angle α* formed between the force vector F22 and the ray having as its origin the point of contact between the wheel 1*a and the pinion 2*b and passing through the axis A2* (or formed between the force vector F20 and a radial vector D* with respect to the axis A2* and having as its origin the point of contact between the wheel 1*a and the pinion 2*b) is appreciably less than 50°, especially less than 30°, or less than 20°.

This intensity of the force F32 is minimized as much as possible if the inertias of the escapement wheels 1*, 2* and the blocking-lever 3* are best minimized. Preferably, the total diameter D2*b of the pinion 2*b is reduced as much as possible in order to best reduce the inertia of the pinion 2*b, as well as the dimensions of the blocking-lever 3*. Thus, preferably, the total diameter D2*b of the pinion 2*b is appreciably less than the total diameter D1*a of the first wheel 1*a, in particular less than 30% of the total diameter D1*a of the first escapement wheel 1*a, or less than 20% of the total diameter D1*a of the first escapement wheel 1*a**.

The toothing profile of the elements 1*a and 2*b may likewise be configured such that the torque transmitted by the first wheel 1*a to the second pinion 2*b during the impulse phase is appreciably greater than that transmitted during the disengagement phase.

During the beginning of the disengagement phase following the resting phase as illustrated in FIG. 14, the torque C2*d*" in the area of the pinion 2*b may be expressed as follows with regard to the torque C1***d*" in the area of the wheel 1*a**, and disregarding friction:

$$C2d''=C1d''\times(DO22/DO12)$$

with:

DO12: the value of the lever arm of the force F22 with respect to the axis A1*;

DO22: the value of the lever arm of the force F22 with respect to the axis A2*.

Upon beginning of the impulse phase as represented in FIG. 15, an impulse surface 201*b of the second pinion 2*b is oriented such that the force F22' transmitted is essentially tangential to the trajectory of the point of contact between the wheel 1*a and the pinion 2*b. In other words, upon beginning of the impulse phase, the force F22' is essentially normal to the ray having as its origin the axis A1* and passing through the axis A2*.

Upon beginning of this impulse phase, the torque C2*i*" in the area of the pinion 2*b may be expressed as follows in relation to the torque C1***i*" in the area of the wheel 1*a**, and disregarding friction:

$$C2i''=C1i''\times(DO22'/DO21')$$

with:

DO21': the value of the lever arm of the force F22' with respect to the axis A1*;

DO22': the value of the lever arm of the force F22' with respect to the axis A2*.

Given that:

$$DO22/DO12<<DO22'/DO21' \text{ and that } C1i''=C1d''$$

The torque C2*i*" transmitted to the pinion 2*b during the impulse phase is appreciably greater than the torque C2***d*" to the pinion 2*b** transmitted during the disengagement phase. Thus, the energy to be furnished by the balance during the disengagement phase is minimized and the energy transmitted by the motor means during the impulse phase to the escapement device is maximized. Such an escapement device thus has the advantage of having an efficiency which is maximized as compared to escapement devices known in the prior art, such as that disclosed in the document WO2013182243A1. Such a device also has the advantage of minimizing the perturbations at the oscillator, and thus allows the implementing of an oscillator with optimized isochronism as compared to oscillators cooperating with escapement devices known in the prior art.

In the third variant of the second embodiment, the geometries of the elements of the escapement may be as described below.

The first escapement wheel 1* comprises teeth 10*a**, in particular 40 teeth. The teeth have for example involute profiles or have substantially involute profiles.

The second escapement pinion 2*b comprises teeth 20*b, in particular 6 teeth. The teeth extend substantially for an angular sector of around 30°. Each tooth comprises a resting surface 200*b** oriented to make an angle β* between 10° and 50°, or between 20° and 35°, with the orthoradial direction O2* with respect to the axis A2* of the second escapement wheel. The angle β* is an acute angle measured between the tangent to the resting surface and an orthoradial vector O2* with respect to the axis A2 and having as its origin the point of contact between the wheel 1*a* and the pinion 2*b. This orientation makes it possible to create a slight torque tending to make the second escapement wheel turn against the blocking-lever in resting and disengagement phases. Each tooth is likewise bounded by two lateral surfaces oriented substantially radially with respect to the axis A2*. one of these two lateral surfaces is an impulse surface 201*b.

The angles α* and β* are thus equal apart from the friction angle (friction angle in the area of the point of contact between the wheel 1*a and the pinion 2*b).

The blocking-lever 3* comprises resting surfaces 300*b, 310*b oriented at least substantially orthoradially with respect to the axis A3* of the blocking-lever and impulse surfaces 301*b, 311*b oriented at least substantially radially with respect to the axis A3* of the blocking-lever.

In resting and disengagement phases, one flank of a tooth 10*a bears against a resting surface 200*b of a tooth 20*b of the second pinion and one tip 200*a of a tooth 20*a of the second wheel bears against a resting surface 310*b, 300*b** of the blocking-lever.

Advantageously, in resting phase and in disengagement phase (while the second escapement wheel is bearing against the blocking-lever), a ray having as its origin the axis A2* of the second escapement wheel and passing through the first point of contact where the first force F22 of the first escapement wheel is applied to the second escapement wheel and a ray having as its origin the axis A2* of the second escapement wheel and passing through the axis A1* of the second escapement wheel make an angle greater than 10°, or greater than 20°, or greater than 30°.

Advantageously, and in supplemental or alternative manner, in resting phase and in disengagement phase (while the second escapement wheel is bearing against the blocking-lever), a ray having as its origin the axis A1* of the first escapement wheel and passing through the axis A2* of the second escapement wheel; and a ray having as its origin the axis A1* of the first escapement wheel and passing through the first point of contact where the first force F22 of the first escapement wheel is applied to the second escapement wheel make an angle greater than 5°, or greater than 10°, or greater than 20°.

In impulse phase, the flank of a tooth 10*a bears against an impulse surface 201*b of a tooth 20*b of the second pinion and one tip 200*a of a tooth 20*a of the second wheel bears against an impulse surface 301*b, 311*b** of the blocking-lever.

In the various embodiments and variants, the first and second escapement wheels and the blocking-lever are preferably made of a low-density material, such as silicon or a silicon alloy. In the case of components of the escapement device made of silicon, the latter are preferably coated with a layer of SiO2 or Si4N3 in particular so as to strengthen their mechanical resistances, and to optimize the tribology of the device. Such a device might not require lubrication, for example.

Preferably, regardless of the embodiment or variant, the resting surfaces of the blocking means of the blocking-lever are concave shapes in order to guarantee the precision of positioning of the teeth of the second escapement wheel 2, 2', 2", 2* on these surfaces. For example, these concave surfaces are formed by two inclined planes making for example an angle preferably between 120° and 170°.

Preferably, regardless of the embodiment or variant, the blocking-lever may be also equipped with mechanical transmission means able to make the second escapement wheel turn in the opposite direction to that of the first escapement wheel. These means may consist of protuberances or teeth acting by contact on the second escapement wheel, particularly on impulse surfaces or on resting surfaces of the second escapement wheel.

Preferably, regardless of the embodiment or variant, the blocking-lever may comprise a safety-pin designed to cooperate with a supplemental balance plate, so as to prevent unwanted movements of the blocking-lever when subjected to a shock.

In the various embodiments and variants, the escapement device is designed to maintain the oscillations of the timepiece oscillator in optimized manner. As previously seen, the device makes it possible to minimize the energy to be furnished by the oscillator during the disengagement phase, that is, when the oscillator actuates the blocking-lever while an escapement wheel is locked in rotation by the blocking-lever.

In the various embodiments and variants, the escapement device has the advantage of having an efficiency which is maximized as compared to escapement devices known in the prior art. Such a device also has the advantage of minimizing the perturbations of the oscillator, and thus allows the implementing of an oscillator with optimized isochronism as compared to oscillators cooperating with escapement devices known in the prior art. To accomplish this, in the various embodiments and variants, the escapement device is such that it transmits from the first escapement wheel to the second escapement wheel a variable torque, depending on whether it is in a disengagement phase or an impulse phase. The torque transmitted from the first escapement wheel to the second escapement wheel in disengagement phase is less than that transmitted from the first escapement wheel to the second escapement wheel in impulse phase. The torque transmitted from the first escapement wheel to the second escapement wheel in impulse phase may be constant or essentially constant. Likewise, the torque transmitted from the first escapement wheel to the second escapement wheel in disengagement phase may be constant or essentially constant. The torque transmitted from the first escapement wheel to the second escapement wheel in disengagement phase may be equal or essentially equal to the torque transmitted from the first escapement wheel to the second escapement wheel in resting phase.

In the various embodiments and variants, the first escapement wheel and the second escapement wheel may form a mechanical transmission device for a timepiece designed to transmit a torque, especially designed to transmit a variable torque and/or a torque from a barrel. Alternatively, the first escapement wheel and the second escapement wheel may be part of a mechanical transmission device for a timepiece designed to transmit a torque, especially designed to transmit a variable torque and/or a torque from a barrel.

On the contrary, according to the prior art, high torques necessary to maintain oscillations of the oscillator during the different impulse phases of the escapement devices are likewise transmitted by the escapement wheel even when such torque levels are not required, in particular, during the different phases of disengagement of the escapement device. The energy lost by friction is proportional to the bearing force of the toothing of the escapement wheel against the blocking-lever and the bearing force is itself proportional to the torque transmitted by the escapement wheel. The result is particularly low efficiencies. Furthermore, in a timepiece the motor means, such as a barrel, distributes to the escapement wheel, via a geartrain, a torque which is essentially constant at the escapement wheel. Thus, the torque transmitted to the escapement wheel is constantly high, which means that the energy to be furnished by the oscillator to enable the disengagement of the blocking-lever is constantly high.

In the various embodiments and variants, the escapement device is preferably such that, in disengagement phase, the blocking-lever acts directly against the second escapement wheel which is in kinematic linkage with the first escapement wheel.

In the various embodiments and variants, the escapement device comprises the blocking-lever, the first escapement wheel and the second escapement wheel which are arranged and configured so as to:

- minimize the torque transmitted in the area of the second escapement wheel during the disengagement phases of the escapement device; and/or
- maximize the torque transmitted in the area of the second escapement wheel or in the area of the oscillator during the impulse phases of the escapement; and/or
- transmit from the first escapement wheel a different torque in disengagement phase and in impulse phase.

In the various embodiments and variants, the escapement device 400; 400'; 400"; 400* comprises preferably a first escapement wheel 1; 1'; 1"; 1*, a second escapement wheel 2; 2'; 2"; 2*, and a blocking-lever 3; 3'; 3"; 3*. The second escapement wheel is preferably situated between the first escapement wheel and the blocking-lever, in particular the second escapement wheel may cooperate by contact with the first escapement wheel on the one hand and with the blocking-lever on the other hand.

In the various embodiments and variants, the first escapement wheel, the second escapement wheel and the blocking-lever are preferably configured and arranged such that in the disengagement phase of the escapement device a force of the blocking-lever controlled by the oscillator 4, 5 is transmitted to the first escapement wheel via the second escapement wheel.

In the various embodiments and variants, the first escapement wheel, the second escapement wheel and the blocking-lever are preferably configured and arranged such that in the disengagement phase of the escapement device a first force of the first escapement wheel is applied to the second escapement wheel and a second force of the blocking-lever is applied to the second escapement wheel, the intensity of the second force being less than the intensity of the first force, in particular, the intensity of the second force being less than 0.5 times, or less than 0.3 times, or less than 0.2 times the intensity of the first force.

In the various embodiments and variants, the first escapement wheel, the second escapement wheel and the blocking-lever are preferably configured and arranged such that in the impulse phase of the escapement device:

- a third force of the first escapement wheel applied directly to the second escapement wheel or applied directly to an oscillator 4, 5 is directed substantially orthoradially with respect to the axis A1; A1'; A1"; A1* of the first escapement wheel or to the axis A2; A2'; A2"; A2* of the second escapement wheel or to the axis A4; A4'; A4"; A4* of the oscillator; and/or
- a fourth force of the second escapement wheel applied directly to the blocking-lever or applied directly to an oscillator is directed substantially orthoradially to the axis A2; A2'; A2"; A2* of the second escapement wheel or to the axis A3; A3'; A3"; A3* of the blocking-lever or to the axis A4; A4'; A4"; A4* of the oscillator.

In the various embodiments and variants, the second escapement wheel 2; 2'; 2"; 2* may be a second pinion 2*b* or the second escapement wheel 2'; 2"; 2* may comprise a second pinion 2*b*'; 2*b*"; 2*b and a second wheel 2***a*'; 2*a*"; 2*a**.

In the various embodiments and variants, the second escapement wheel 2; 2'; 2"; 2* may comprise a second pinion 2*b*'; 2*b*"; 2*b, the second pinion being arranged to cooperate with the first escapement wheel, the first escapement wheel, particularly a first wheel of the first escapement wheel, having a diameter greater than, particularly more than 1.5 times greater than, or more than 2 times greater than the diameter of a second pinion of a second escapement wheel 2; 2'; 2"; 2***.

In the various embodiments and variants, the second escapement wheel 2; 2'; 2"; 2* may comprise impulse surfaces 201*b*'; 201*b*"; 201*b oriented at least substantially radially with respect to the axis A2; A2'; A2"; A2* of the second escapement wheel and/or resting surfaces 200***b*; 200*b*'; 200*b*"; 200*b** oriented to form an angle β; β'; β"; β* between 15° and 50°, or between 20° and 45°, between the tangent to the resting surface and an orthoradial vector O2; O2'; O2"; O2* with respect to the axis A2; A2'; A2"; A2* of the second escapement wheel in the area of the resting surface and/or the blocking-lever may comprise impulse surfaces 31*b*"; 301*b, 311*b oriented at least substantially radially with respect to the axis of the blocking-lever A3; A3'; A3"; A3* and/or resting surfaces 30*b*, 30*c*; 30*b*', 30*c*'; 30*b*", 30*c*"; 30*b, 30*c oriented at least substantially orthoradially with respect to the axis of the blocking-lever A3; A3'; A3"; A3*.

In the various embodiments and variants, the second wheel may comprise impulse surfaces 201*a*" oriented at least substantially orthoradially with respect to the axis A2; A2'; A2"; A2* of the second escapement wheel and/or resting surfaces 200*a*" oriented at least substantially radially with respect to the axis of the second escapement wheel A2; A2'; A2"; A2* and/or the second pinion may comprise impulse surfaces 201*b*'; 201*b*"; 201*b oriented at least substantially radially with respect to the axis of the second escapement wheel A2; A2'; A2"; A2* and/or resting surfaces 200***b*; 200*b*'; 200*b*"; 200*b** oriented to form an angle β; β'; β"; β* between 15° and 50°, or between 20° and 45°, between the tangent to the surface and an orthoradial vector O2; O2'; O2"; O2* with respect to the axis of the second escapement wheel A2; A2'; A2"; A2* in the area of the resting surface.

In the various embodiments and variants, the first escapement wheel, the second escapement wheel and the blocking-lever may be configured and arranged such that in the disengagement phase of the escapement device a first force F2; F20; F21; F22 of the first escapement wheel on the second escapement wheel at a first point of contact makes an angle α; α'; α"; α* less than 50°, or less than 30°, or less than 20° with a radial vector D; D'; D"; D* with respect to the axis of the second escapement wheel A2; A2'; A2"; A2* at the first point of contact and/or the first escapement wheel, the second escapement wheel and the blocking-lever may be configured and arranged such that in the disengagement phase:

- a ray having as its origin the axis A2; A2'; A2"; A2* of the second escapement wheel and passing through a first point of contact where a first force F2; F20; F21; F22 of the first escapement wheel is applied to the second escapement wheel; and
- a ray having as its origin the axis A2; A2'; A2"; A2* of the second escapement wheel and passing through the axis A1; A1'; A1"; A1* of the second escapement wheel;

make an angle greater than 10°, or greater than 20°, or greater than 30°;

and/or

- a ray having as its origin the axis A1; A1'; A1"; A1* of the first escapement wheel and passing through the axis A2; A2'; A2"; A2* of the second escapement wheel; and
- a ray having as its origin the axis A1; A1'; A1"; A1* of the first escapement wheel and passing through a first point of contact where a first force F2; F20; F21; F22 of the first escapement wheel is applied to the second escapement wheel;

make an angle greater than 5°, or greater than 10°, or greater than 20°.

According to the various embodiments, the watch movement 500; 500'; 500"; 500* may comprise an escapement device as previously described, in particular, it may comprise the geartrain 1*b*'; 1*b*"; 1*b, the oscillator 4, 5** and an escapement device as previously described. The escapement device is situated between the geartrain and the oscillator.

According to the various embodiments, the timepiece 600; 600'; 600"; 600* may comprise an escapement device as previously described or a watch movement as previously described or a timepiece transmission device as previously described.

One embodiment of a method of functioning of an escapement device, especially an escapement device as described above, is detailed below.

The method may involve a disengagement phase, in which there are simultaneously applied to the second escapement wheel:

- a first force F2; F20; F21; F22 of the first escapement wheel, and
- a second force F3; F30; F31; F32 of the blocking-lever.

The intensity of the second force may be less than the intensity of the first force, in particular, the intensity of the second force may be less than 0.5 times, or less than 0.3 times, or less than 0.2 times the intensity of the first force.

The method may involve an impulse phase in which the first escapement wheel applies, directly to the oscillator or directly to the second escapement wheel, a third force directed substantially orthoradially with respect to the axis of the first escapement wheel or to the axis of the second escapement wheel or to the axis of the oscillator.

The method may involve an impulse phase in which the second escapement wheel applies, directly to the oscillator or directly to the blocking-lever, a fourth force directed substantially orthoradially with respect to the axis of the second escapement wheel or to the axis of the blocking-lever or to the axis of the oscillator.

The method may involve an impulse phase in which the intensity of the torque transmitted from the first escapement wheel to the second escapement wheel or to an oscillator during the impulse phase is greater than 1.5 times, or greater than 2 times, the intensity of the torque transmitted from the first escapement wheel to the second escapement wheel during a disengagement phase.

By "escapement wheel" is meant in this entire document a wheel or a pinion or an assembly of wheel(s) and/or pinion(s).

By "wheel" is meant in this entire document any rotary toothed element whose function is to transmit a torque, a force, or a movement.

By "pinion" is meant in this entire document any rotary toothed element whose function is to transmit a torque, a force, or a movement, whose diameter and/or whose number of teeth is substantially less than that of the wheel with which it meshes or with which it is joined firmly in rotation.

Throughout this document, unless otherwise indicated, the angles mentioned are oriented angles. By convention, the positive direction of orientation of these angles is the direction of rotation of the second escapement wheel when the escapement device is in operation. In all the figures representing particular embodiments, this positive direction of orientation of the angles is the trigonometric or counter-clockwise direction.

By "radial direction with respect to an axis" is meant, in this entire document, any direction perpendicular to this axis and passing through this axis. The radial vector is in this radial direction and oriented toward this axis.

By "orthoradial direction with respect to an axis" is meant, in this entire document, any direction perpendicular to this axis and perpendicular to the radial direction with respect to this axis. The orthoradial direction with respect to an axis at a given point is thus the tangential direction with respect to this axis at the given point. The orthoradial vector is perpendicular to this radial direction and oriented such that the angle between the orthoradial vector and the radial vector is an oriented angle of +90°.

By "direction essentially orthoradial with respect to an axis" is preferably meant, in this entire document, any direction orthoradial to this axis or any direction making an angle of less than 30°, or less than 20°, with a direction exactly orthoradial with respect to this axis.

By "direction essentially radial with respect to an axis" is preferably meant, in this entire document, any direction radial to this axis or any direction making an angle of less than 30°, or less than 20°, with a direction exactly radial with respect to this axis.

In this entire document, the orientation of a surface is preferably defined by the tangential direction to this surface in the plane perpendicular to the pivoting axes of the escapement wheels and/or the blocking-lever.

By "impulse surface of the second escapement wheel" is preferably meant, in this entire document, any surface of the second escapement wheel able to be in contact with the first escapement wheel or with the blocking-lever during an impulse phase of the escapement device.

By "resting surface of the second escapement wheel" is preferably meant, in this entire document, any surface of the second escapement wheel able to be in contact with the first escapement wheel or with the blocking-lever during a resting phase or a disengagement phase of the escapement device.

By "impulse surface of the blocking-lever" is preferably meant, in this entire document, any surface of the blocking-lever able to be in contact with the second escapement wheel during an impulse phase of the escapement device.

By "resting surface of the blocking-lever" is preferably meant, in this entire document, any surface of the blocking-lever able to be in contact with the second escapement wheel during a resting phase or a disengagement phase of the escapement device.

By "escapement wheel" is meant preferably in this entire document any movable element for transmission of a force from the wheelwork to the blocking-lever, the movable element being configured and/or arranged such that the direction of the force which it transmits varies, in particular it varies substantially, during an escapement cycle.

The invention claimed is:

1. A method of operating an escapement device situated between a wheel of a geartrain and an oscillator, the escapement device comprising a first escapement wheel pivoted about a first axis, a second escapement wheel pivoted about a second axis, and a blocking-lever, the method comprising:

in a disengagement phase, applying simultaneously to the second escapement wheel:

a first force by the first escapement wheel, and a second force by the blocking-lever, wherein the intensity of the second force is less than 0.5 times the intensity of the first force with a lever arm of the first force with respect to the second axis being smaller than a lever arm of the second force with respect to the second axis.

2. The method of operating as claimed in claim 1, comprising, in an impulse phase, applying, by the first escapement wheel, directly to the oscillator or directly to the second escapement wheel, a third force directed substantially orthoradially with respect to an axis of the first escapement wheel or to an axis of the second escapement wheel or to an axis of the oscillator.

3. The method of operating as claimed in claim 1, comprising, in an impulse phase, applying, by the second escapement wheel, directly to the oscillator or directly to the blocking-lever, a fourth force directed substantially orthoradially with respect to an axis of the second escapement wheel or to an axis of the blocking-lever or to an axis of the oscillator.

4. The method of operating as claimed in claim 1, further comprising, in an impulse phase, transmitting a torque from the first escapement wheel to the second escapement wheel or to the oscillator, wherein the intensity of the torque transmitted from the first escapement wheel to the second escapement wheel or to the oscillator is greater than 1.5 times the intensity of the torque transmitted from the first escapement wheel to the second escapement wheel during the disengagement phase.

5. The method of operating as claimed in claim 1, wherein the intensity of the second force is less than 0.3 times the intensity of the first force.

6. The method of operating as claimed in claim 5, wherein the intensity of the second force is less than 0.2 times the intensity of the first force.

7. An escapement device comprising:

a first escapement wheel, a second escapement wheel, and a blocking-lever, wherein the second escapement wheel is situated between the first escapement wheel and the blocking-lever, and wherein the second escapement wheel comprises a second pinion, the second pinion being arranged to cooperate with the first escapement wheel, the first escapement wheel having a diameter greater than the diameter of the second pinion of the second escapement wheel.

8. The escapement device as claimed in claim 7, wherein the first escapement wheel, the second escapement wheel and the blocking-lever are configured and arranged so that, in a disengagement phase of the escapement device, a force of the blocking-lever controlled by an oscillator is transmitted to the first escapement wheel via the second escapement wheel.

9. The escapement device as claimed in claim 7, wherein the first escapement wheel, the second escapement wheel and the blocking-lever are configured and arranged so that, in a disengagement phase of the escapement device, a first force of the first escapement wheel is applied to the second escapement wheel and a second force of the blocking-lever is applied to the second escapement wheel, the intensity of the second force being less than the intensity of the first force.

10. The escapement device as claimed in claim 7, wherein the first escapement wheel, the second escapement wheel and the blocking-lever are configured and arranged so that, in the impulse phase of the escapement device:

a third force of the first escapement wheel applied directly to the second escapement wheel or applied directly to an oscillator is directed substantially orthoradially with respect to an axis of the first escapement wheel or to an axis of the second escapement wheel or to an axis of the oscillator; and/or a fourth force of the second escapement wheel applied directly to the blocking-lever or applied directly to an oscillator is directed substantially orthoradially to the axis of the second escapement wheel or to the axis of the blocking-lever or to the axis of the oscillator.

11. The escapement device as claimed in claim 7, wherein the second escapement wheel is a second pinion or the second escapement wheel comprises a second pinion and a second wheel.

12. The escapement device as claimed in claim 11, wherein the second wheel comprises impulse surfaces oriented at least substantially orthoradially with respect to an axis of the second escapement wheel and/or resting surfaces oriented at least substantially radially with respect to the axis of the second escapement wheel; and/or wherein the second pinion comprises impulse surfaces oriented at least substantially radially with respect to an axis of the second escapement wheel and/or resting surfaces oriented to form an angle in a range of from 15° to 50° between a tangent to the surface and an orthoradial vector with respect to the axis of the second escapement wheel in the area of the resting surface.

13. The escapement device as claimed in claim 7, wherein the second escapement wheel comprises impulse surfaces oriented at least substantially radially with respect to an axis of the second escapement wheel and/or resting surfaces oriented to form an angle in a range of from 15° to 50° between a tangent to the surface and an orthoradial vector with respect to the axis of the second escapement wheel in an area of the resting surface; and/or wherein the blocking-lever comprises impulse surfaces oriented at least substantially radially with respect to an axis of the blocking-lever and/or resting surfaces oriented at least substantially orthoradially with respect to the axis of the blocking-lever.

14. The escapement device as claimed in claim 7, wherein the first escapement wheel, the second escapement wheel and the blocking-lever are configured and arranged so that, in the disengagement phase of the escapement device, a first force of the first escapement wheel on the second escapement wheel at a first point of contact makes an angle less than 50° with a radial vector with respect to an axis of the second escapement wheel at the first point of contact; and/or wherein the first escapement wheel, the second escapement wheel and the blocking-lever are configured and arranged so that, in the disengagement phase:

a ray having as its origin the axis of the second escapement wheel and passing through a first point of contact where a first force of the first escapement wheel is applied to the second escapement wheel; and a ray having as its origin the axis of the second escapement wheel and passing through the axis of the second escapement wheel;

make an angle greater than 10°;

and/or a ray having as its origin an axis of the first escapement wheel and passing through the axis of the second escapement wheel; and a ray having as its origin the axis of the first escapement wheel and passing through a first point of contact where a first force of the first escapement wheel is applied to the second escapement wheel;

make an angle greater than 5°.

15. A watch movement comprising a geartrain, an oscillator and an escapement device as claimed in claim 7, the escapement device being situated between the geartrain and the oscillator.

16. A timepiece comprising a watch movement as claimed in claim 15.

17. The escapement device as claimed in claim 7, wherein the diameter of the first escapement wheel is more than 1.5 times greater than the diameter of the second pinion.

18. The escapement device as claimed in claim 17, wherein the diameter of the second pinion is less than 60% of the diameter of the first escapement wheel.

19. The escapement device as claimed in claim 18, wherein the diameter of the second pinion is less than 50% of the diameter of the first escapement wheel.

20. A mechanical transmission device for a timepiece designed to transmit a torque to an escapement wheel, comprising:

a pinion having resting surfaces and impulse surfaces, mounted on a same axis as the escapement wheel, a wheel or first escapement wheel subjected to a torque from a barrel, wherein the resting surfaces and the impulse surfaces are arranged so that the torque transmitted by the wheel or first escapement wheel to the pinion in the impulse phase is greater than 1.5 times the torque transmitted by the wheel to the pinion in the disengagement phase.

21. The mechanical transmission device as claimed in claim 20, wherein the angle between the normal to a resting surface of the second pinion and the straight line between a point of contact on the resting surface to said axis is in a range of from 0 to 60°.

22. The mechanical transmission device as claimed claim 20, wherein the number of teeth of the pinion is equal to the number of teeth of the escapement wheel.

23. The mechanical transmission device as claimed in claim 20, wherein the number of teeth of the pinion is equal to twice the number of teeth of the escapement wheel.

24. The mechanical transmission device as claimed in claim 20, wherein the number of teeth of the escapement wheel is less than or equal to ten.

25. A timepiece provided with a mechanical transmission device as claimed in claim 20.

26. The mechanical transmission device as claimed in claim 20, wherein the torque transmitted by the wheel or first escapement wheel to the pinion in the impulse phase is greater than 2 times the torque transmitted by the wheel to the pinion in the disengagement phase.

* * * * *